US005757329A

United States Patent [19]

Hoover et al.

[11] Patent Number: 5,757,329

[45] Date of Patent: May 26, 1998

[54] SLOTTED ARRAY ANTENNA WITH SINGLE FEEDPOINT

[75] Inventors: John C. Hoover, Roswell; Steven F. Hering, Lawrenceville, both of Ga.

[73] Assignee: EMS Technologies, Inc., Norcross, Ga.

[21] Appl. No.: 580,802

[22] Filed: Dec. 29, 1995

[51] Int. Cl.[6] ..... H01Q 13/18

[52] U.S. Cl. ..... 343/770; 29/600

[58] Field of Search ..... 343/771, 770; 29/600; H01Q 13/18, 13/10

[56] References Cited

U.S. PATENT DOCUMENTS 4,581,614 4/1986 LaCourse ..... 343/771

4,658,261 4/1987 Reid et al. ..... 343/771

*Primary Examiner*—Michael C. Wimer

*Attorney, Agent, or Firm*—Jones & Askew, LLP

[57] ABSTRACT

The antenna includes an antenna body, comprising a conductive material, having a cavity surrounded by intersecting wall segments. The wall segments include a rear plate and a face plate having a planar array of longitudinal slots, and both plates are positioned in spaced-apart parallel planes. The antenna further includes a center wall, centrally placed between the face plate and the rear plate, to form within the cavity a parallel pair of waveguide channels. The center bar has a center bar opening extending longitudinally along a portion of the center bar, thereby separating the center bar portion into first and second center bar segments. A guidance hole is aligned with an edge of the center bar and extends through the first center bar segment and at least a portion of the second center bar segment. A probe distributes radio frequency (RF) energy in substantially equal phase and amplitude to the waveguide channels via the center bar opening. The probe includes a probe pin, which is inserted within the guidance hole and passes through both the first center bar segment and the center bar opening and into the portion of the second center bar segment. The geometry of the probe design supports the coupling of the RF energy to the center bar opening and into each of the quadrants represented by the pair of waveguide channels.

37 Claims, 17 Drawing Sheets

REAR VIEW

SIDE VIEW

FRONT VIEW

Probe Equivalent Electrical Circuit

| SLOT | LENGTH |
|---|---|
| A | 3.926 |
| B | 3.926 |
| C | 3.818 |
| D | 3.818 |
| E | 4.192 |
| F | 3.506 |
| G | 4.192 |
| H | 3.506 |
| J | 3.818 |
| K | 3.818 |
| L | 3.926 |
| M | 3.926 |

TABLE I

SLOTTED ARRAY ANTENNA WITH SINGLE FEEDPOINT

FIELD OF THE INVENTION

This invention is generally directed to a feed distribution system for an antenna and, more particularly described, is a single feedpoint for a waveguide-implemented planar array antenna having longitudinal slots.

BACKGROUND OF THE INVENTION

A common feature of the architecture of a number of systems for wireless radio frequency communications, including wireless local loop (WLL) services, cellular mobile radiotelephone (CMR) services, and personal communications services (PCS), is the provision of a communications link between a plurality of fixed sites. For CMR, PCS, and other systems designed to provide communications capability to mobile subscribers, communications links are used between cell sites and for connection to the public switched telephone network (PSTN). For WLL systems in rural and/or developing areas, communications links may be required between cell sites and to fixed subscribers, as well as for cell-to-cell and PSTN connections.

To provide communications links between fixed sites, wireless systems typically employ directive radio frequency (RF) antennas mounted on towers and directed toward other fixed antenna sites. A wide range of antenna design choices is available depending on design factors, such as operating frequency, required antenna gain, efficiency, power handling, cost, wind resistance, and other factors. Antennas suitable for fixed communication site applications include Yagis, parabolic reflectors, Hogg horns, patch arrays, and slot arrays.

For conventional "wired" telecommunications systems, the cost per line in sparsely-populated areas may be five to ten times the cost per line in urban areas. Wireless local loop (WLL) systems offer a more costeffective alternative to such conventional wired systems in many areas of the world. While CMR systems were originally deployed in urban areas and have been marketed as a premium service in those areas, the technology developed for cellular communications is now being deployed within WLL systems in many developing nations where a fixed-wire telecommunications infrastructure is limited or inadequate. Because of the large service area that can be covered by CMR technology, capital costs for deployment of WLL systems are generally substantially lower than for fixed-wire networks providing ubiquitous coverage to an equivalent area. WLL systems typically complement a limited fixed-wire system, but in some situations WLL systems may be more economical to deploy as a complete alternative telecommunications system.

Most WLL systems are configured as simplified versions of existing analog or digital cellular systems. Analog systems can be deployed more rapidly than digital systems, and the cost of digital subscriber equipment is not expected to become competitive with analog subscriber equipment costs until around the year 2000. Moreover, digital systems have a limited coverage range because of special provisions which must be made to compensate for transmission delays; in analog systems, coverage range is limited only by considerations of power, antenna performance, and terrain. A common analog system standard is the U.S. Advanced Mobile Phone System (AMPS), which operates over the 824 MHz to 894 MHz band.

On the other hand, digital systems make more efficient use of a limited RF spectrum and promise very low subscriber equipment costs once economies of scale have been realized. Digital systems typically employ time division multiple access (TDMA) or code division multiple access (CDMA) modulation techniques which alleviate congestion in high-density areas. Digital cellular standards available to deployers of WLL systems include the European Groupe Speciale Mobile (GSM) system operating over the 890 MHz to 960 MHz band, the Personal Communications Network (PCN) standard operating near 1800 MHz, the Digital European Cordless Telecommunications (DECT) standard, and the cordless telephone generation-2 (CT-2) standard.

To enable the deployment of WLL and other wireless communications systems in remote and/or developing areas of the world, regardless of which of the above CMR standards is employed, a need exists for a low-cost, environmentally-robust antenna providing at least moderate antenna gain for fixed-site communications, particularly within the frequency spectrum near 900 MHz and 1800 MHz and at higher frequencies. Yagi, parabolic reflector, and helical coil type-antennas are suitable for use as a fixed site antenna for wireless communications within this frequency spectrum, but these antennas exhibit a relatively large surface area that leads to the disadvantage of substantial wind loading. Moreover, in view of their relatively large size, many find these antennas to be an undesirable solution because of their inherent lack of visual appeal. In other words, these antennas fail to provide a low profile solution for a fixed antenna installation. Patch-type flat plate antennas, which are typically implemented by etching a dielectric substrate, can be used to provide a low profile antenna for this fixed site antenna application. However, patch-type antennas are generally not viewed as an economical solution because the etching process is a relatively expensive manufacturing technique and the radiating patch elements require environmental protection. Moreover, if a large number of patch elements are required to obtain desired antenna gain, the feed network becomes complex and lossy. This loss is undesirable because it directly subtracts from the antenna gain.

Slotted array antennas, which can provide a low profile solution to the fixed site antenna requirements for a cellular communications application, have typically been used for aircraft radar applications and in electronic warfare environments. For the typical high power radar system, the slotted array antenna uses a waveguide distribution network for distributing the RF energy to and from slot elements. This leads to a relatively complex waveguide design, including T-elements and hybrid components, which can be expensive to produce and assemble. In contrast, the feed distribution network for slotted array antennas in low power applications traditionally have been implemented by microstrip designs. However, a microstrip design requires etching of a dielectric substrate and electrical contact soldering, which lead to relatively high production costs. Also, a microstrip design of a feed distribution network requires protection from the environment. Both the waveguide and microstrip-implemented feed distribution networks typically include multiple transitions, which can contribute to signal loss for the communications system.

Thus, there exists a need for a low profile antenna having a simple feed distribution network and exhibiting the characteristics of low-cost, moderate antenna gain, and environmental robustness. The present invention overcomes the disadvantages of prior art antenna designs by providing (1) an antenna with a simplified feed which replaces the power divider structures utilized in prior art antennas, and (2) an approach to the manufacture of a slotted array antenna that relies upon simple, costeffective sheet metal manufacturing processes. Specifically, the present invention provides a low profile, RF antenna based on a waveguideimplemented slotted array design employing a single probe element to provide moderate antenna gain in an environmentally-robust configuration that is realizable at very low cost.

SUMMARY OF THE INVENTION

The present invention provides significant advantages over the prior art by providing a distribution network having a single probe element to distribute radio frequency (RF) energy to and from a waveguide-implemented planar array of slot elements. The antenna includes an antenna body, comprising a conductive material, having a cavity surrounded by intersecting wall segments. The wall segments include a rear plate and a face plate having a planar array of longitudinal slots, and both plates are positioned in spaced-apart parallel planes. The antenna further includes a center bar, centrally placed between the face plate and the rear plate, to form within the cavity a parallel pair of waveguide channels.

The center bar has a center bar opening extending longitudinally along a portion of the center bar, thereby separating the center bar portion into first and second center bar segments. The first center bar segment is positioned adjacent to the rear plate, whereas the second center bar segment is located adjacent to the face plate. The center bar opening is positioned at the approximate midpoint of the center bar and is substantially parallel to both the front plate and the rear plate. The length of the center bar opening is typically defined by approximately ½ wavelength of a center frequency of operation for the antenna.

A guidance hole is aligned with an edge of the center bar and extends through the first center bar segment and at least a portion of the second center bar segment. The guidance hole comprises first and second cylindrical holes, wherein the first cylindrical hole is place within the first center bar segment and the second cylindrical hole is placed in the second center bar segment. Consequently, the center bar has sufficient thickness to allow the guidance hole to be placed within its base.

A probe assembly distributes radio frequency (RF) energy in substantially equal phase and amplitude to the waveguide channels via the center bar opening. The geometry of the probe design supports the coupling of the RF energy to the center bar opening and into each of the quadrants represented by the pair of waveguide channels. The probe assembly includes a probe pin, which comprises a conductive material, for insertion within the guidance hole. The probe pin passes through the first cylindrical hole and the center bar opening, and into the second cylindrical hole. In this manner, the probe pin passes through the conductive surface of the first center bar segment, extends along the center bar opening, and enters a portion of conductive surface of the second center bar segment. The first cylindrical hole can have a slightly larger diameter than the second cylindrical hole to provide improved an improved impedance matching characteristic for the probe assembly.

The probe can further include a dielectric tuning element, which is located within the guidance hole in the second center bar segment. The dielectric tuning element can be positioned adjacent to a tip of the probe pin, for adjusting the impedance presented by the probe to the waveguide channels. The dielectric tuning element can comprise an air gap between the tip of the probe pin and an enclosed end of the guidance hole within the second center bar segment. Alternatively, the dielectric tuning element can comprise a sleeve of dielectric material placed around the periphery of the tip of the probe pin.

The antenna also can include an antenna connector that is mounted to the rear plate and electrically connected to the probe via an opening within the rear plate and aligned with the guidance hole. The antenna connector includes a center conductor for transporting the RF energy to and from the probe. In particular, the center conductor can be used as the probe pin of the probe.

In the place of the antenna connector, the antenna can include an electronic module connected to the rear plate of the antenna. The electronic module can include a receiver and/or a transmitter, each electrically connected to the probe pin of the probe for respectively receiving and transmitting signals of the RF energy.

For another aspect of the invention, the slotted antenna includes a relatively thin center bar that is centrally placed between the face plate and the rear plate and forms within the cavity a pair of waveguide channels. A portion of the center wall comprises a center wall opening extending longitudinally along the center wall portion and a center wall segment defining the remaining segment of the center wall portion. The center wall opening is preferably positioned adjacent to the rear plate, whereas the center wall segment is placed adjacent to the face plate of the antenna.

Similar to the previously described aspect of the instant invention, a probe assembly distributes RF energy in substantially equal phase and amplitude to the waveguide channels via the center wall opening. The probe assembly can include a probe pin inserted within the center wall opening for coupling the RF energy and a dielectric segment for adjusting the impedance presented by the probe to the waveguide channels. The dielectric segment, which comprises a dielectric material having a selected dielectric constant, is positioned proximate to each side of the center wall segment and adjacent to the center wall opening.

In contrast to the center bar for the invention aspect described above, the center wall for this aspect of the invention does not have sufficient thickness to support the placement of a guidance hole within its base for the insertion of a probe pin. Consequently, the probe pin has a tip including a pair of legs separated by at least the space defined by the width of a combination of the center wall segment and the dielectric segment. The legs are positioned proximate to sides of the center wall segment to clamp the dielectric segment between the tip of the probe pin and the center wall. In this manner, the probe pin is physically supported by the center wall and the dielectric segment is held in place along the center bar segment between the legs of the U-shaped probe tip.

It is an object of the present invention to provide a low-cost, environmentally-robust antenna providing at least moderate antenna gain for fixed-site cellular communications.

It is a further object of the present invention to provide a distribution network having a single feed point for a planar array antenna having longitudinal slots.

It is a further object of the present invention to provide a simple and economical distribution network for a planar array antenna having longitudinal slots.

It is a further object of the present invention to provide a probe for distributing RF energy in equal phase and amplitude to parallel waveguide channels of a planar array antenna having longitudinal slots.

It is a further object of the present invention to provide an economical and efficient process for manufacturing a slotted array antenna of the present invention.

These and other advantages of the present invention will become apparent from the detailed description and drawings to follow and the appended claim set.

DETAILED DESCRIPTION OF EMBODIMENTS OF THE PRESENT INVENTION

Figure 1:
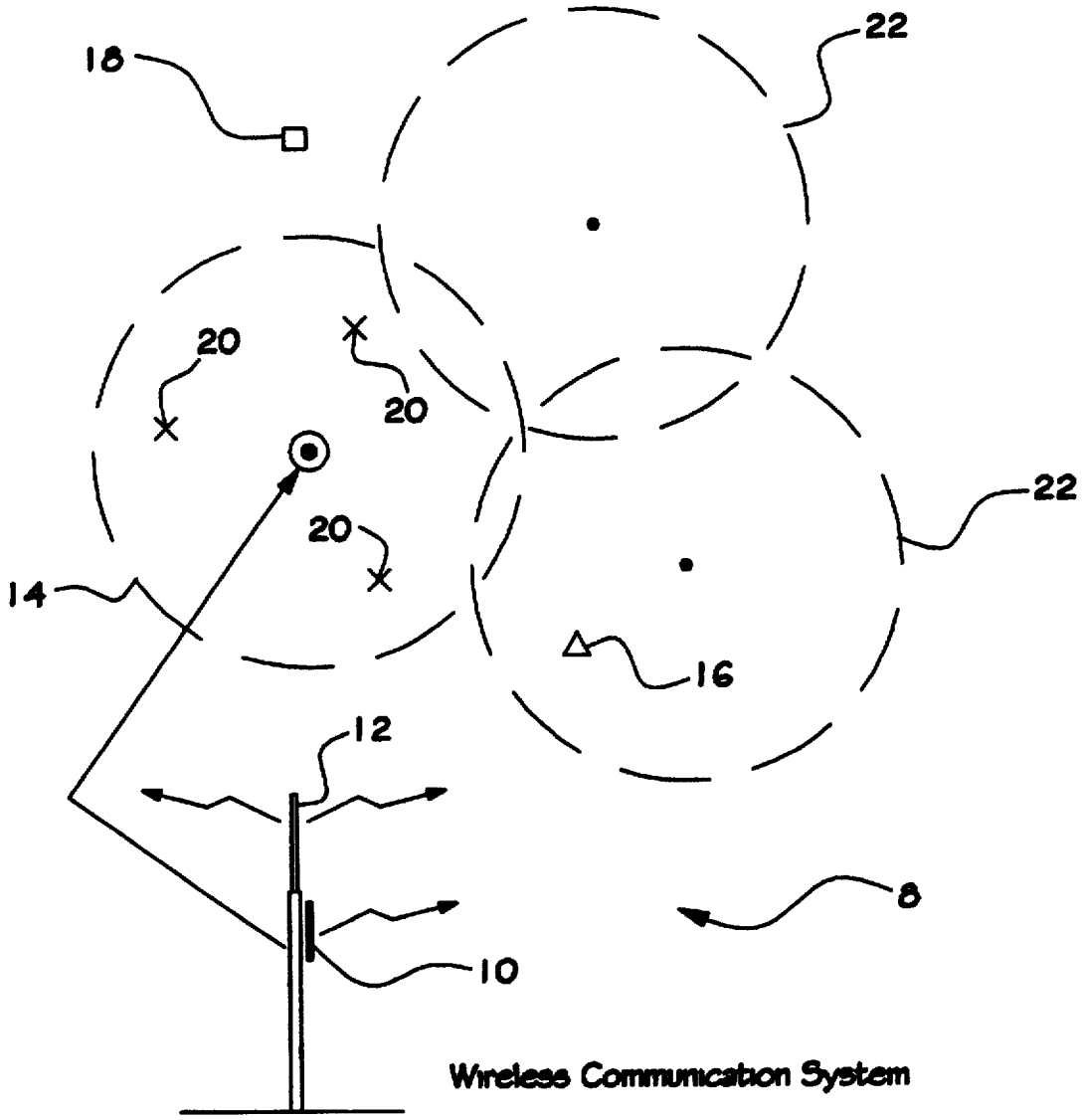
FIG. 1 is a block diagram showing the operating environment of a wireless radio frequency communications system employing the preferred embodiment of the present invention.

The antenna of the present invention is primarily useful as a fixed-site antenna for transmitting and/or receiving radio frequency (RF) signals cost-effectively in a wide variety of wireless communications applications, including wireless local loop (WLL) services, cellular mobile radiotelephone (CMR) services, and personal communications services (PCS). The antenna comprises a planar array of slot radiating elements, also described as slots, which are fed by a symmetrical feedpoint or launch point. Significantly, the antenna may be manufactured from inexpensive materials processed by simple metal forming methods, and the antenna may be assembled using procedures requiring relatively little time and skill. Consequently, the antenna provides cost advantages over prior art antennas providing similar gain and frequency spectrum characteristics.

Those skilled in the art will appreciate that the cost of communications antennas may constitute a significant portion of the total cost of deploying a wireless communications system, and that design techniques which provide for sufficient system performance while minimizing system cost are therefore desirable. For an antenna with a coverage requirement which is both fixed and directive, an antenna designer will be typically presented with design objectives including a minimum gain requirement, the ability to withstand wind, rain and other environmental stresses, ease of installation, minimum material costs, minimum fabrication costs, and minimum assembly costs.

It will be appreciated that an antenna formed by an array of waveguide slot radiators comprises a low-profile antenna which can provide significant antenna gain. However, the expenses associated with antenna manufacturing and providing a feed distribution network for a slotted array antenna can be significant, and these expenses have previously precluded incorporating slotted array antennas into wireless communications systems. Advantageously, the present invention provides a slotted array antenna incorporating (1) a simplified feed which replaces the waveguide or microstrip feed structures utilized in prior antennas, and (2) a manufacturing approach that relies upon simple, cost-effective sheet metal manufacturing processes.

Prior to discussing the embodiments of the antenna provided by the present invention, it will be useful to review the salient features of an antenna formed by a planar array of waveguide slot radiators. An attractive feature of the slot as a radiating element in an antenna system is that an array of slots may be integrated into a feed distribution system without requiring any special matching network. For example, an energy distribution network, typically formed in a waveguide or stripline transmission medium, typically provides energy to each radiating element. Low-profile, high-gain antennas can be configured using slot radiators, although such antennas are generally bandwidth-limited by input voltage standing wave ratio (VSWR) performance.

A slot cut into the wall of a waveguide interrupts waveguide wall current flow and will couple energy from the waveguide into free space. Waveguide slots may be characterized by their shape and location on the wall of the waveguide and by their equivalent electrical circuits. A slot cut into the broad wall of a waveguide and oriented parallel to the direction of propagation interrupts only transverse currents and may be represented equivalently by a two-terminal shunt admittance. These slots are commonly known as shunt slots. By comparison, a slot cut into the broad wall of a waveguide, but oriented perpendicularly to the direction of propagation, will interrupt only longitudinal currents. This type of slot cut can be represented by a series impedance, and is hence commonly termed a series slot. Equivalent circuit conductance and susceptance values for particular shunt and series slots may be determined with the aid of measured data and design equations that are well known to those persons skilled in the art. References describing the conventional design of slotted array antennas include: Hung Yuet Yee, *Slot-Antenna Arrays*, ch. 9 in *Antenna Engineering Handbook* (McGrawHill 1984, Johnson & Jasik, eds.); Robert Elliott, *The Design of Waveguide-Fed Slot Arrays*, ch. 12 in *Antenna Handbook* (Van Nostrand Reinhold, Lo & Lee, eds.).

After individual slot element characteristics have been determined, the designer of a linear resonant slot array must specify slot locations and resonant conductances. This supports the design for an antenna impedance match and determines the aperture feed distribution. Slot spacing is limited by the appearance of grating lobes for slot spacings of one free-space wavelength or more and by the requirement that all slots be illuminated in-phase. To meet both requirements simultaneously, slots are typically spaced at one-half of the waveguide wavelength along the waveguide centerline and on alternating sides of the centerline. An array of shunt slots in the broad waveguide wall thus spaced will produce radiation polarized perpendicularly to the array axis.

The basic building block of a linear resonant slot array is a single waveguide section fed from either end or the center of the waveguide. The number of slots in the waveguide is practically limited by input VSWR bandwidth and by array element pattern requirements. Basic design requirements include: (1) the sum of all normalized slot resonant conductances are nominally made to be equal to 2 for a center feed (or 1 for an end feed), and (2) the radiated power from each slot location is proportional to that slot's resonant conductance. The sum of all normalized slot resonant conductances may purposely be made different from the matched condition to achieve a greater usable bandwidth or the feed network may have impedance transformation characteristics that can accomplish the matching. In the preferred embodiment of the antenna described below, the slots are designed to radiate equal power, so the resonant conductance of all slots is designed to be equal.

To construct a planar resonant slot array, two or more linear slot arrays are placed side-by-side and are fed together. Mutual-coupling effects among slots in adjacent waveguides should be accommodated. Antenna gain can be increased by adding additional linear slot arrays.

In a conventional planar resonant slot array, illumination of the slot elements is typically accomplished with either a waveguide end feed or a series slot, i.e., slots located in the narrow wall of a waveguide, each being fed in turn by a power divider network. Particularly for large arrays, the power divider network may become quite complex and may dominate total antenna cost. It is well known to those skilled in the art that judicious design of the power divider network is important in achieving a cost-effective antenna design. The present invention addresses these issues by using a single probe to provide a novel and economical feed distribution network for a planar resonant slot array antenna.

Turning now to the drawings, in which like reference numbers refer to like elements, FIG. 1 is a diagram illustrating the typical operating environment for a wireless RF communications system employing the preferred embodiment of the present invention. Referring to FIG. 1, in a wireless communications system 8, an antenna 10 in a communications cell 14 provides fixed point-to-point communication of RF signals to a fixed subscriber 16, a fixed communications facility 18, or adjacent communications cells 22. An omnidirectional ("omni") antenna 12 associated with the communications cell 14 provides RF communications coverage to a mobile subscriber 20 within a geographic area surrounding the omni antenna. For a typical WLL application, the antenna 10 and the omni antenna 12 will be co-located within the same communications cell to permit signals received by the omni antenna 12 to be readily relayed to the directional antenna 10 and, likewise, signals received by the antenna 10 to be transferred to the omni antenna 12. In this manner, the signals received by the omni antenna 12 can be forwarded to the fixed subscriber 16, the fixed communications facility 18, or the adjacent communications cell 22 via the antenna 10. Thus, the antenna 10 readily supports point-to-point communications between fixed communications sites.

Figure 4:
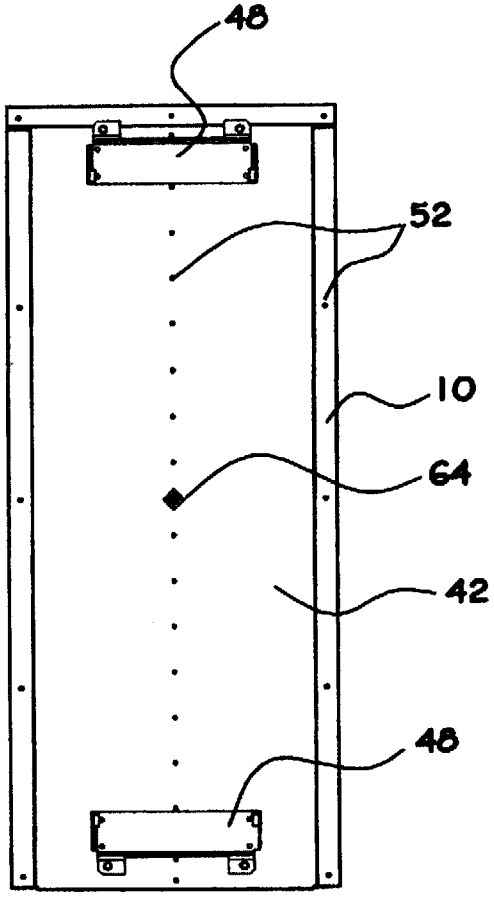
FIG. 4 is an illustration showing a side view of an antenna for the preferred embodiment of the present invention.

As will be described in detail below with respect to FIGS. 2–4, the antenna 10 is particularly useful for wireless communications systems requiring a low profile antenna supporting directional communications coverage. The antenna 10 is preferably implemented as a waveguide antenna employing a parallel set of linear arrays of waveguide slot radiators. In particular, the antenna 10 provides a planar array formed by two side-by-side, center-fed linear arrays supplying moderate gain for the selected frequency spectrum of operation. This slotted array implementation of the antenna 10 supports a low profile based on its flat plate appearance. It is for such moderate-gain applications that the preferred antenna avoids the need for a conventional power divider network design by using a probe to distribute the RF energy to the waveguide channels of the antenna.

Figures 2A, 2B, 2C:
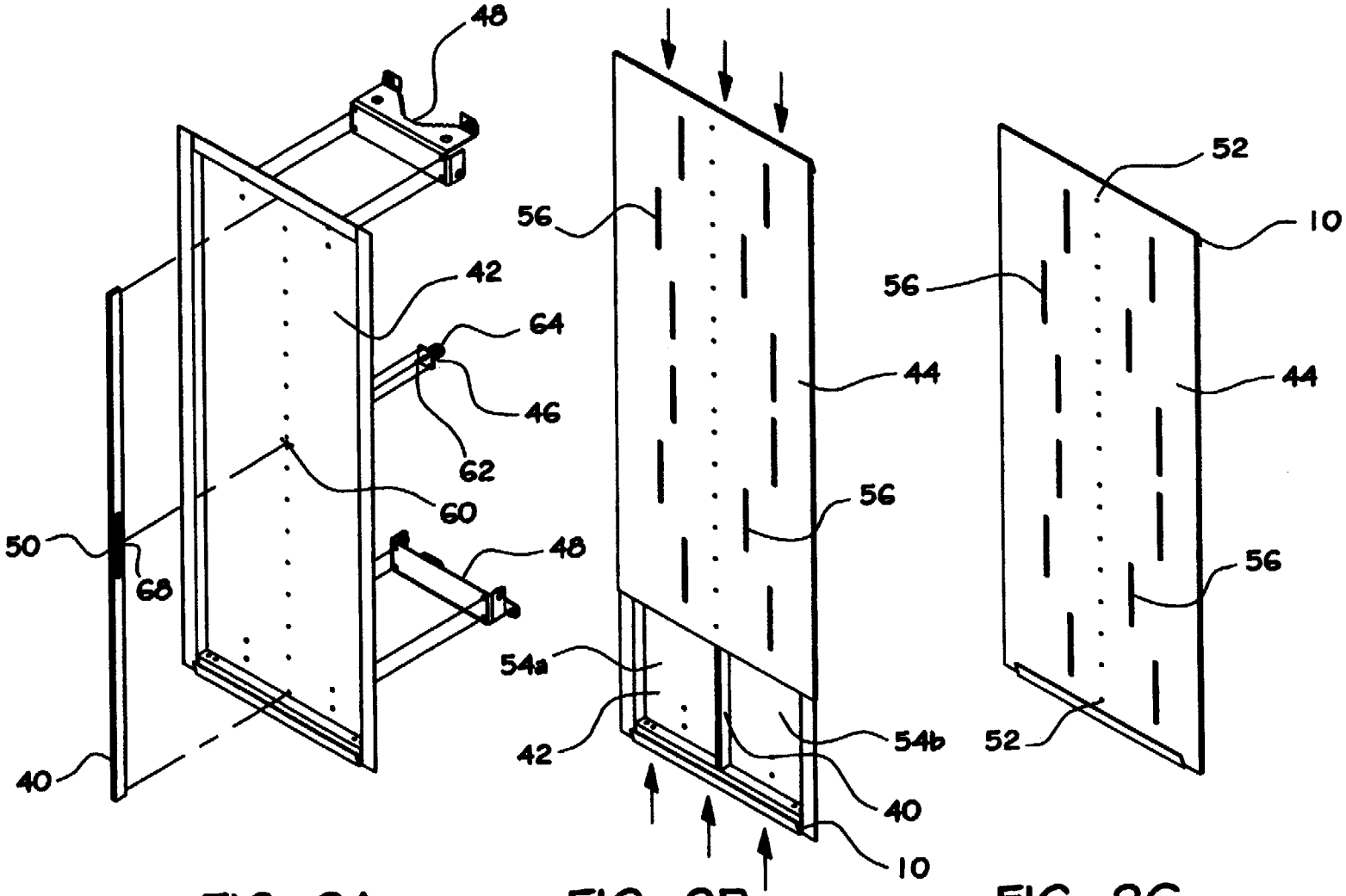
FIGS. 2A, 2B, and 2C, collectively described as FIG. 2, are illustrations showing certain aspects of the assembly of an antenna for the preferred embodiment of the present invention.
Figure 5:
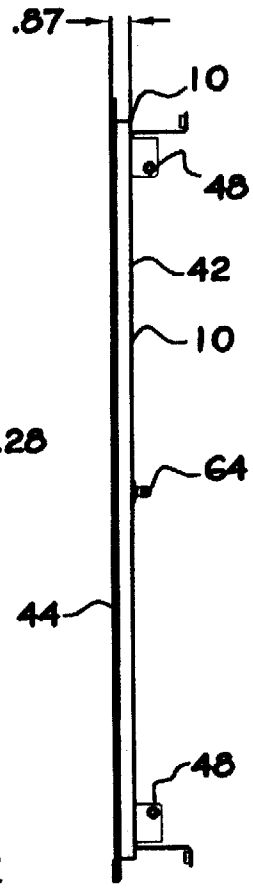
FIG. 5 is an illustration showing a rear view of an antenna for the preferred embodiment of the present invention.
Figure 3:
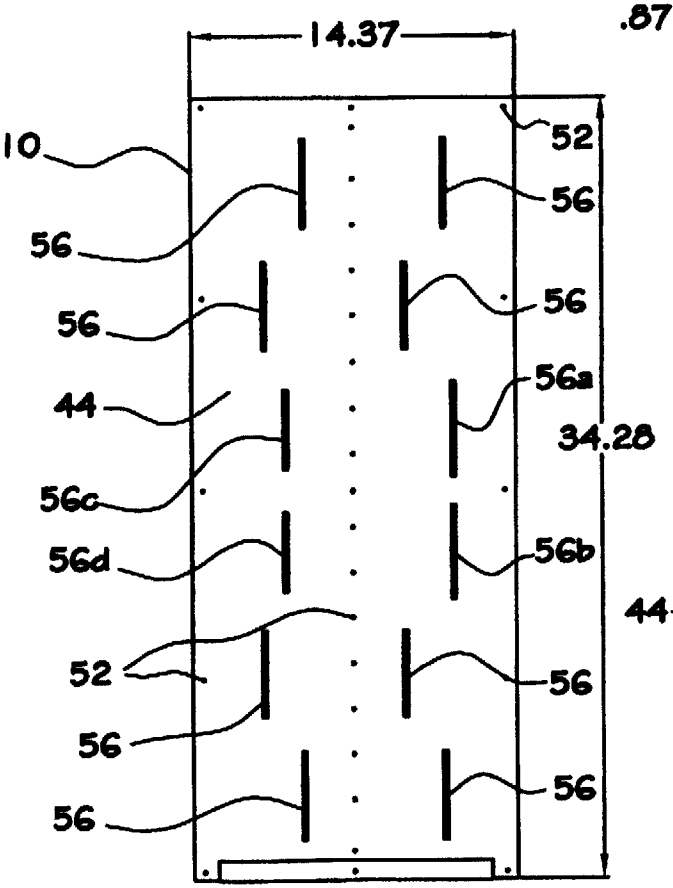
FIG. 3 is an illustration showing a front view of an antenna for the preferred embodiment of the present invention.
Figure 6B:
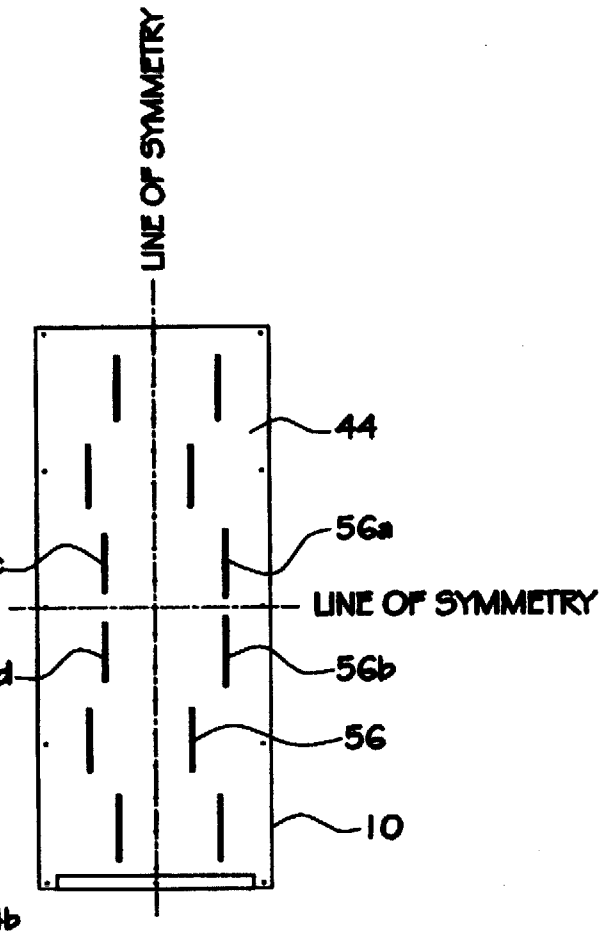
FIGS. 6A and 6B, are illustrations showing the preferred location of a probe within an operating environment of an antenna for the preferred embodiment of the present invention.
Figure 6A:
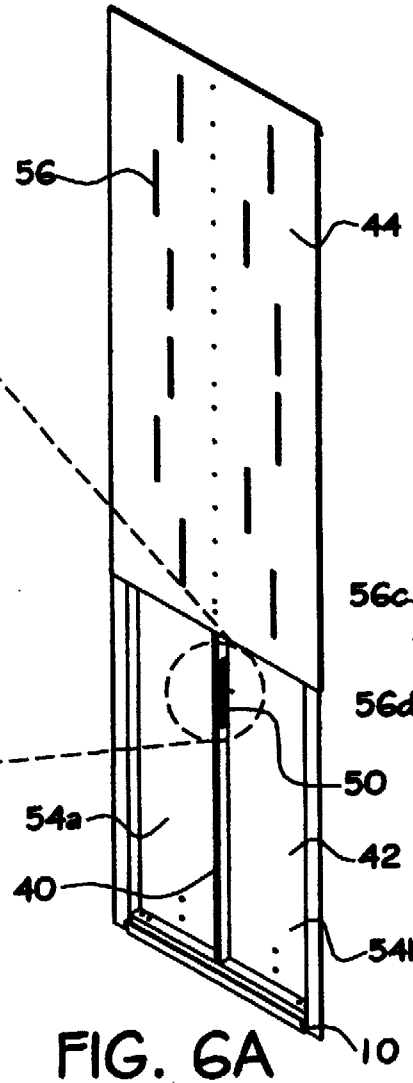
Figure 6C:
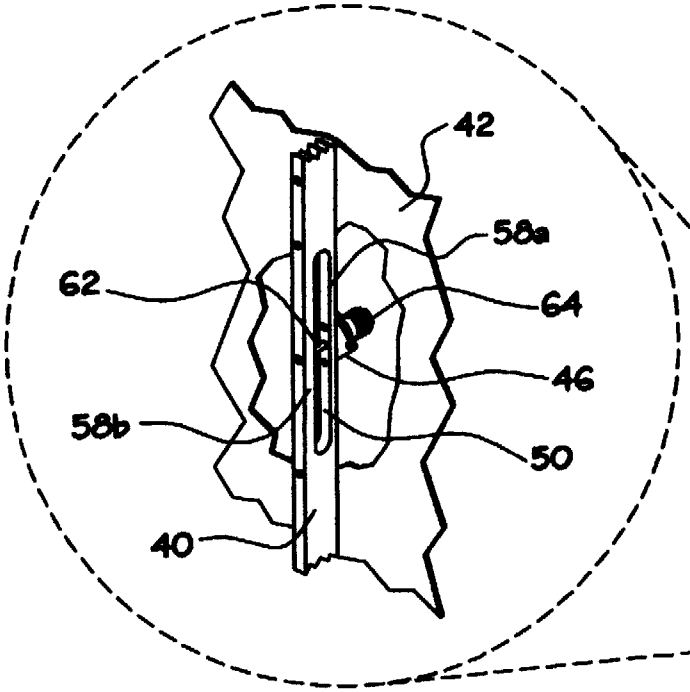
FIG. 6C is an illustration showing an expanded view of the installation of the probe shown in FIG. 6A.

FIGS. 2A–C, collectively described as FIG. 2, are illustrations showing the assembly of the primary components of the antenna 10, and highlight the preferred construction of the antenna. FIGS. 3, 4, and 5, respectively, provide front, side, and rear views of the antenna 10. FIGS. 6A, 6B, and 6C, collectively described as FIG. 6, provide a detailed view of the preferred probe assembly for distributing RF energy to the antenna 10. All dimensions supplied by FIGS. 3–5 are in inches.

Referring now to FIGS. 2–6, a center bar 40 is installed along the center of a rear plate 42. A face plate 44 is also attached to the remaining edge of the center bar 40, thereby forming a cavity within an antenna assembly defined by the intersecting walls of the rear plate 42 and the face plate 44. Within this cavity of the antenna assembly, the centrally-located center bar 40 creates two waveguide channels **54*a* and 54*b*, whereby the center bar 40, the rear plate 42, and the face plate 44 form the walls of the waveguide channels. In particular, the waveguide channels 54*a* and 54*b* share a common wall represented by the center bar 40. The center bar 40, the rear plate 42, and the face plate 44** comprise conductive material, preferably aluminum sheeting.

The center bar 40, the rear plate 42 and the face plate 44 are attached to one another by fasteners, such as rivets 52, which are spaced approximately 2 inches apart along the center bar 40 and approximately 6 inches along the periphery of the antenna assembly. As good design practice, this 2-inch spacing is selected because it is less than a one-half wavelength at the operating frequency, thereby preventing RF leakage between the two waveguide channels 54*a* and 54*b*. A pair of mounting brackets 48 permit the installation of the completed antenna 10 on a tower, building, or other appropriate mounting structure for the specified application.

The face plate 44 includes radiating slots 56, which provide the radiating elements for the antenna 10 and can be modeled as dipole-type radiators. The configuration of the radiating slots 56 along the face plate 44, which is best shown in FIG. 3, are preferably spaced at one-half of the wavelength for the center operating frequency and placed along alternating sides of a centerline extending the major dimension axis of the face plate 44. Specifically, each of the waveguide channels 54*a* and 54*b* includes radiating slots spaced along their respective portion of the face plate 44. Thus, the slots 56, which are shunt-type slots, produce radiation polarized perpendicularly to this major dimension axis. Each slot 56 is cut into the broad wall of the face plate 44 and oriented parallel to the direction of signal propagation, thereby interrupting the transverse currents of the corresponding waveguide channel 52*a* or 52*b*.

The center bar 40 includes a center bar opening 50, which is best viewed in FIG. 6, extending longitudinally along at least a portion of the center bar. In particular, the center bar opening 50 separates this portion of the center bar 50 into first and second center bar segments 58*a* and 58*b*. The first center bar segment 58*a* is positioned adjacent to the rear plate 42, whereas the second center bar segment 58 is located adjacent to the face plate 44. The center bar opening 50, which separates the first center bar segment 58a from the second center bar segment 58*b*, is positioned at the approximate midpoint of the center bar 50 and is substantially parallel to both the rear plate 42 and the face plate 44. The length of the center bar opening 50 is defined by approximately ½ wavelength of a center frequency of operation for the antenna 10.

A probe assembly 46 distributes RF energy to the waveguide channels 54*a* and 54*b* via an extension within the center bar opening 50 and, in turn, this RF energy is passed to the slots 56. The probe assembly 46 is centrally located both with respect to the center bar 40 and to the waveguide channels 54*a* and 54*b*. The probe assembly 46 is preferably installed along the rear surface of the rear plate 42 and extends within the cavity of the antenna 10 via a probe opening 60 in the rear plate 42. The probe opening 60 is aligned with the midpoint of the center bar 40 to allow the extension of the probe assembly 46, a probe pin 62, to enter the antenna cavity via a clearance hole in the center bar 40. In particular, the probe pin 62, enters the probe opening 60, passes through a clearance or guidance hole within the first center bar segment 58*a* and the center bar opening 50, and extends within at least a portion of the center bar segment 58*b*.

The probe assembly 46 also can include an antenna connector 64, which supports a cabled-connection of RF energy between a transmit and/or receive source and the antenna 10. The antenna connector 64, which is typically implemented as a coaxial-type receptacle, such as an N-type connector, can receive a male connector connected to the feed cabling. The antenna connector 64 includes a center conductor that can be directly connected to the probe pin 62 or is implemented as an integral part of the probe pin 62. In this manner, RF energy can be distributed between the antenna connector 64 and the probe 62. The antenna connector is typically connected to the surface of the rear plate 42 via fasteners, such as threaded mounting screws, thereby securing the probe assembly 46 to the antenna 10.

Alternatively, an electronic module (not shown) can be used in place of the antenna connector to directly connect a receiver and/or a transmitter to the rear surface of the antenna 10. The electronic module is directly connected to the probe pin 62 to support the exchange of RF signals between the module and the antenna. This implementation eliminates any requirement for using an extended length of coaxial cabling to connect the receiver and/or transmitter to the antenna connector (and to the antenna).

The probe assembly 46 feeds RF energy into waveguide channels 54*a* and 54*b* equally in phase and in amplitude, and the radiating slots 56 are therefore fed in-phase. Each of the waveguide channels 54*a* and 54*b* include two halves, and the antenna 10 resulting from the combination of these waveguide sticks can be viewed as having four distinct quadrants. The center point for these quadrants is preferably defined by the location of the probe assembly 46. Thus, a four-way feed network is provided by the present invention, which is a result of the symmetry of the structure of antenna 10 and the central placement of the probe assembly 46. As will be described in more detail below with respect to FIGS. 7–9, the symmetrical design features of the probe assembly 46 provide a proper impedance match for the load presented by the antenna 10.

For the preferred embodiment, the antenna 10 provides at least 16 dBi of gain over a frequency range of 1420 MHz to 1530 MHz. This gain figure may be accomplished by choosing piece part dimensions to yield internal dimensions of waveguide channels 54*a* and 54*b* of 6.0 inches wide X 0.75 inches high X 32.2 inches long. The radiating slots 56 are nominally 4.0 inches long and 0.187 inches wide and are placed along the face plate 44, which has a thickness of 0.062 inches. The rear plate 42 and the face plate 44 each have a preferred thickness of 0.062 inches. To provide environmental protection, the slots 56 can be covered by a radiating, waterproof material, such as 3M's "SCOTCH" brand 838 weather resistant film tape , is applied to the exterior surface of the face plate 44.

It will be understood that the sizes and positions of the most centrally located radiating slots 56*a*, 56*b*, 56*c*, and 56*d*, i.e., those four slots located most closely to probe assembly 46, can be adjusted to account for the distortion of RF energy distribution in the waveguide channels 54*a* and 54*b* resulting from the presence of the probe assembly 46 and center bar opening 50. This adjustment is illustrated in FIG. 3, which shows slots 56*a–d* positioned in an alternative placement on the face plate 44 in comparison to the remaining slots 56. The size and position adjustments may be determined with the use of conventional RF field modeling tools, such as Hewlett-Packard's 85180A High-Frequency Structure Simulator (HFSS) or similar modeling tools.

Figure 7:
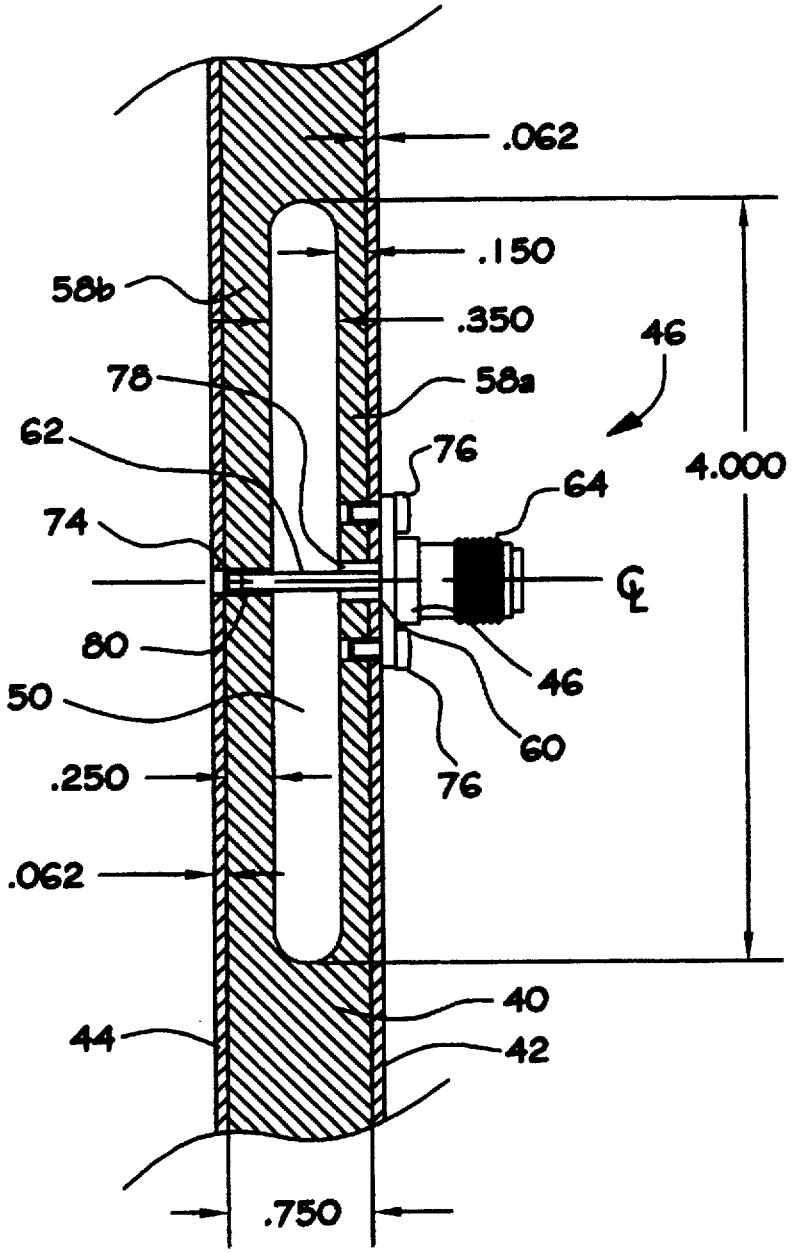
FIG. 7 is an illustration showing a cross-sectional view of a probe assembly and a center bar opening for the preferred embodiment of the present invention.
Figure 8:
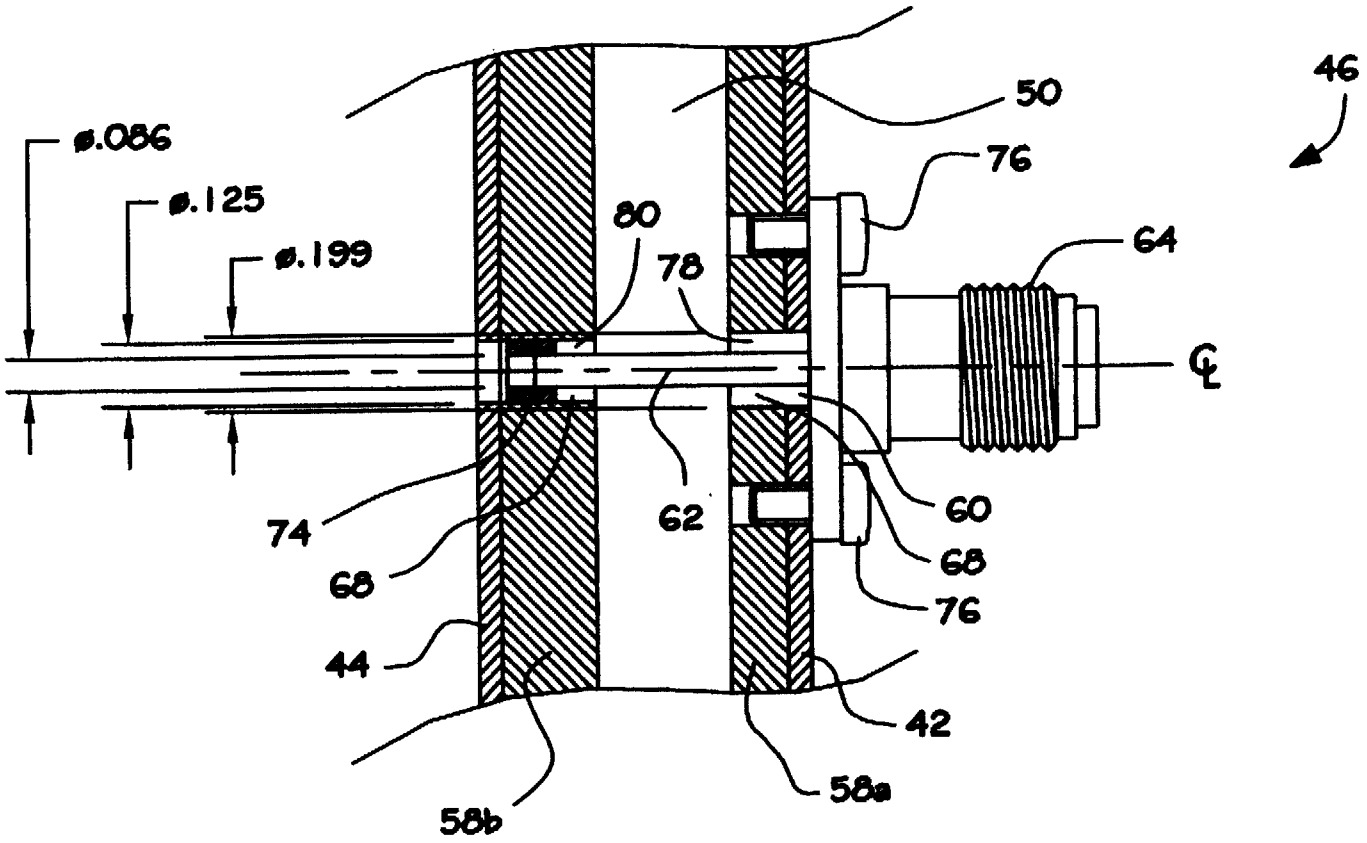
FIG. 8 is an illustration showing a cross-sectional view of a probe assembly for the preferred embodiment of the present invention.

FIGS. 7 and 8 provide cross-sectional views of the probe assembly and its associated dimensions. Each of the cross-sectional views of FIGS. 7 and 8 is taken along the length of the center bar 40, thereby illustrating the connection of the probe assembly 46 to the rear plate 42 and to the center bar 40. Turning now to FIGS. 2 and 6–8, to couple energy from a RF transmitter and/or receiver to the radiating slots 56, the probe assembly 46 is mounted to rear plate 42 using the fasteners 76. In particular, the antenna connector 64, is mounted to the outside of the rear plate 42 via fasteners 76 installed within two clearance holes in the rear plate 42. In turn, these clearance holes extend into two tapped holes within the center bar 40, which can accept the fasteners 76. To avoid extending the mounting holes into the center bar opening 50, the depth of the tapped holes in the center bar 40 should be less than the thickness of that portion of center bar 40 which is between the center bar opening 50 and the rear plate 42.

A guidance hole 68, also described as a clearance hole, comprises a first cylindrical hole 78 and a second cylindrical hole 80. The guidance hole 68 is positioned within the midpoint of the center bar 40 and extends to the center bar opening 50. The guidance hole 68 accepts the extension of the probe assembly 46, specifically the probe pin 62, which passes through the first cylindrical hole 78 and the center bar opening 50, and extends into the second cylindrical hole 80. Therefore, the guidance hole 68 must be sized to accept the diameter and length of the probe pin 62. It will be appreciated that the dimensions of the probe pin 62 can affect the impedance matching characteristic of the probe assembly 46.

The first cylindrical hole 78 is located in the center of center bar 40 and within the first center bar section 58*a*, i.e., that portion of the center bar 40 which is between the center bar opening 50 and the rear plate 42. The second cylindrical hole 80 is located in the center of center bar 40 in the second center bar segment 58*b*, i.e., that portion of the center bar 40 which is between the center bar opening 50 and the face plate 44. Although FIG. 7 illustrates that the second cylindrical hole 80 does not necessarily need to extend through the center bar 40 to reach the face plate 44, it will be understood that certain designs of the probe assembly may support such an extension. The preferred probe dimensions, as detailed below for the frequency range of 1420 MHz–1530 MHz, yield a design that requires the second cylindrical hole 80 to extend only partially through the second center bar section 58*b* of the center bar 40. In addition, to improve the load matching characteristics of the probe assembly 46, the first cylindrical hole 78 preferably has a slightly larger diameter than the second cylindrical hole 80.

The probe opening 60 within the rear plate 42 is preferably aligned with the first cylindrical hole 78 and, therefore, the combination of the probe opening 60 and the first cylindrical hole 78 can be formed by a single drilling action after the center bar 40 has been attached to the rear plate 42. The second cylindrical hole 80 preferably does not extend through the surface of the face plate 44 and, consequently, can be formed within the center bar 50 by using the first cylindrical hole 78 as a drill reference guide. The first cylindrical hole 78 can have a slightly larger diameter than the second cylindrical hole 80. The diameter of the first cylindrical hole 78 is selected to provide a particular characteristic impedance when the probe pin 62 is inserted. For the preferred embodiment, the selected characteristic impedance value is 50 ohms. A smaller diameter for the second cylindrical hole 80 is selected to achieve a greater capacitance per unit length, thereby minimizing the length of the probe pin 62 needed to achieve the desired value of capacitance.

The probe pin 62, which comprises a conductive material, such as type 303 Beryllium Copper, per QQ-C-530, gold-plated per MIL-G-45204. The probe pin 62 preferably has a symmetrical shape. For improved load matching performance, the preferred probe pin 62 has a cylindrical shape and a rounded tip on the probe end. The particular shape of the probe pin 62 or the guidance hole is not critical so long as symmetry and correct impedance values are maintained. For example, a square or rectangular cross-section for the probe pin 62 (and corresponding guidance hole) can be used as an alternative to the preferred cylindrical shape. Specifically, the probe pin 62 could have a cross-section of 0.100 inches×0.005 inches and the cylindrical holes 78 and 80 could have a corresponding rectangular cross-section to achieve the preferred impedance of 50 ohms. Consequently, it will be understood that the present invention is not limited to a probe pin having a cylindrical shape, but can be extended to other symmetrical shapes.

The probe pin 62 can be connected to the center conductor of the antenna conductor 64, which operates as the feed mechanism for providing RF energy from the external environment to the antenna assembly. However, the preferred implementation of the probe pin 62 is to use the center conductor of the antenna connector 64 as an integral extension of the probe assembly 46. For this preferred implementation, the center conductor of the antenna connector 64 can be cut to the proper length after procurement of the connector or, alternatively, an antenna connector can be obtained with a pre-specified length of the center conductor corresponding to the specified dimensions of the probe pin.

The probe assembly 46 also can include a dielectric tuning element 74, which comprises a selected dielectric material. The dielectric tuning element 74 can be placed within the second cylindrical hole 80 for tuning the probe assembly 46. The dielectric tuning element 74 is preferably positioned adjacent to a tip of the probe pin 62 and within the second cylindrical hole 80. In the event that the selected dielectric material is air, an air gap will extend from the tip of the probe pin 62 to the end of the second cylindrical hole 80. In contrast, if the dielectric tuning element 74 is a solid material, the dielectric tuning element 74 can have a cylindrical shape, and serve to position the tip of the probe pin 62 centrally within the second cylindrical hole 80. For example, the dielectric tuning element 74 can be formed as a sleeve that encompasses the tip of the probe pin 62 to provide additional mechanical support for the probe pin 62.

The dielectric tuning element 74 can be used as a capacitive tuning element to adjust impedance matching characteristics of the probe assembly 46. For example, the location of the dielectric tuning element 74 along the probe pin 62 and within the second cylindrical hole 80 can be adjustable. This tuning feature also can be used to optimize performance over limited changes in operating frequency.

The preferred dielectric material for dielectric tuning element 74 is "TEFLON". Alternative dielectric materials for the dielectric tuning element 74 can include "ULTEM" or any low loss, plastic material having a low hydroscopic characteristic. Those skilled in the art will appreciate that the dielectric constant and the length of the dielectric tuning element 74 can be empirically determined to achieve the desired impedance matching performance.

Those skilled in the art will appreciate that the performance of the symmetrical feed approach presented by the probe assembly 46 relies upon the symmetrical location of the probe pin 62, the first cylindrical hole 78, the second cylindrical hole 80, and the optional dielectric tuning element 74 with respect to one another and to both the center bar 40 and the center bar opening 50. This symmetrical design approach for the probe assembly 46 is critical for providing equal phase and amplitude RF signals to each quadrant of the waveguide sticks 52*a* and 52*b*.

Preferred dimensions for elements of the probe assembly 46 are provided by the cross-sectional views of FIGS. 7 and 8. All dimensions supplied by these drawings are in inches. For the antenna 10 operating within the frequency range between 1420 MHz and 1530 MHz, as shown best in FIG. 7, the width of the center bar 40 is 0.75 inches; the thickness of the rear plate 42 and the face plate 44 is 0.062 inches; the center bar opening 50 is 0.350 inches wide and 4.0 inches long; and the first center bar segment 58*a* is 0.15 inches wide, whereas the second center bar segment 58*b* is 0.25 inches wide. Turning now to FIG. 8, the diameter of the probe pin 62 is 0.086 inches, the diameter of the first cylindrical hole 78 is 0.199 inches, and the diameter of the second cylindrical hole 80 is 0.125 inches.

Those skilled in the art will appreciate that some frequency scaling of the probe dimensions shown in FIGS. 7–8 is possible. To scale successfully, all dimensions should be scaled. However, unlike the sheet metal thickness and antenna connector diameters, many of the probe dimensions that control the impedance value are not conveniently scaled. For this reason, those skilled in the art will appreciate that design dimensions for the preferred probe assembly at frequencies distant from 1500 MHz will not scale well, and that the use of the HFSS modeling tool or equivalent conventional modeling tools will be required to implement the preferred probe assembly at those other frequencies.

Figure 9:
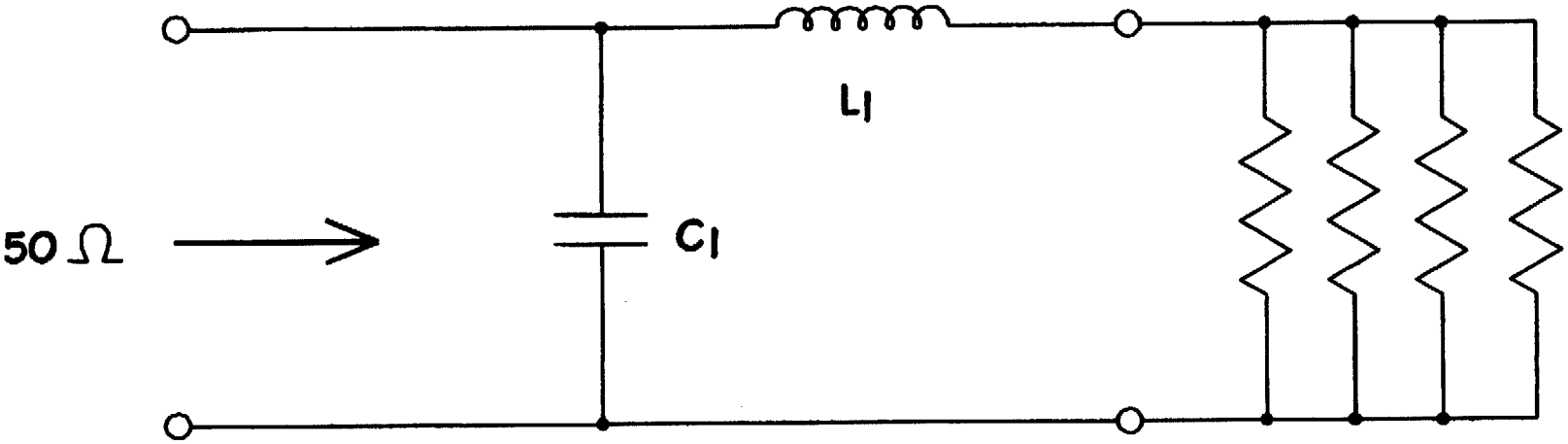
FIG. 9 is a schematic showing an equivalent electrical circuit for a probe assembly for the preferred embodiment of the present invention.

Referring now to the probe equivalent circuit shown in FIG. 9, the challenge presented by the probe design is matching a standard 50 ohm transmission line impedance, which is presented by the antenna 10 at the antenna connector 64, to the shunt impedances that represent the two symmetrically-fed linear resonant slot arrays. The probe assembly 46 can be schematically represented by an LC circuit comprising the L1 and C1 components, whereas the load associated with the waveguide channels 52*a* and 52*b* are schematically represented by four shunt impedances. By designing the physical dimensions of the probe pin 62 and that portion of the antenna assembly proximate to the probe assembly 46 to provide the appropriate values of the series inductance L1 and the shunt capacitance C1, the four waveguide shunt impedances can be matched to the desired 50 ohm transmission line impedance.

To design the physical dimensions to accomplish such an impedance match, a modeling tool such as Hewlett-Packard's model 85180A HFSS modeling tool, or an equivalent modeling tool, is again very useful. Using the HFSS modeling tool, those skilled in the art can determine proper dimensions for the diameter and length of the probe pin 62, the depth and diameter of first cylindrical hole 78, the depth and diameter of second cylindrical hole 80, and the length, width, and depth of center bar opening 50. As described above, it is important that the locations and sizes of the four most centrally located radiating slots 56*a*, 56*b*, 56*c*, and 56*d*, i.e., those four slots located most closely to probe assembly 46, should be adjusted to account for the distortion of RF energy distribution in the waveguide channels 54*a* and 54*b* resulting from the presence of the probe assembly 46 and the center bar opening 50. This adjustment is preferably performed in conjunction with the determination of probe assembly dimensions by the use of HFSS or equivalent modeling tools.

Figures 10A, 10B, 10C:
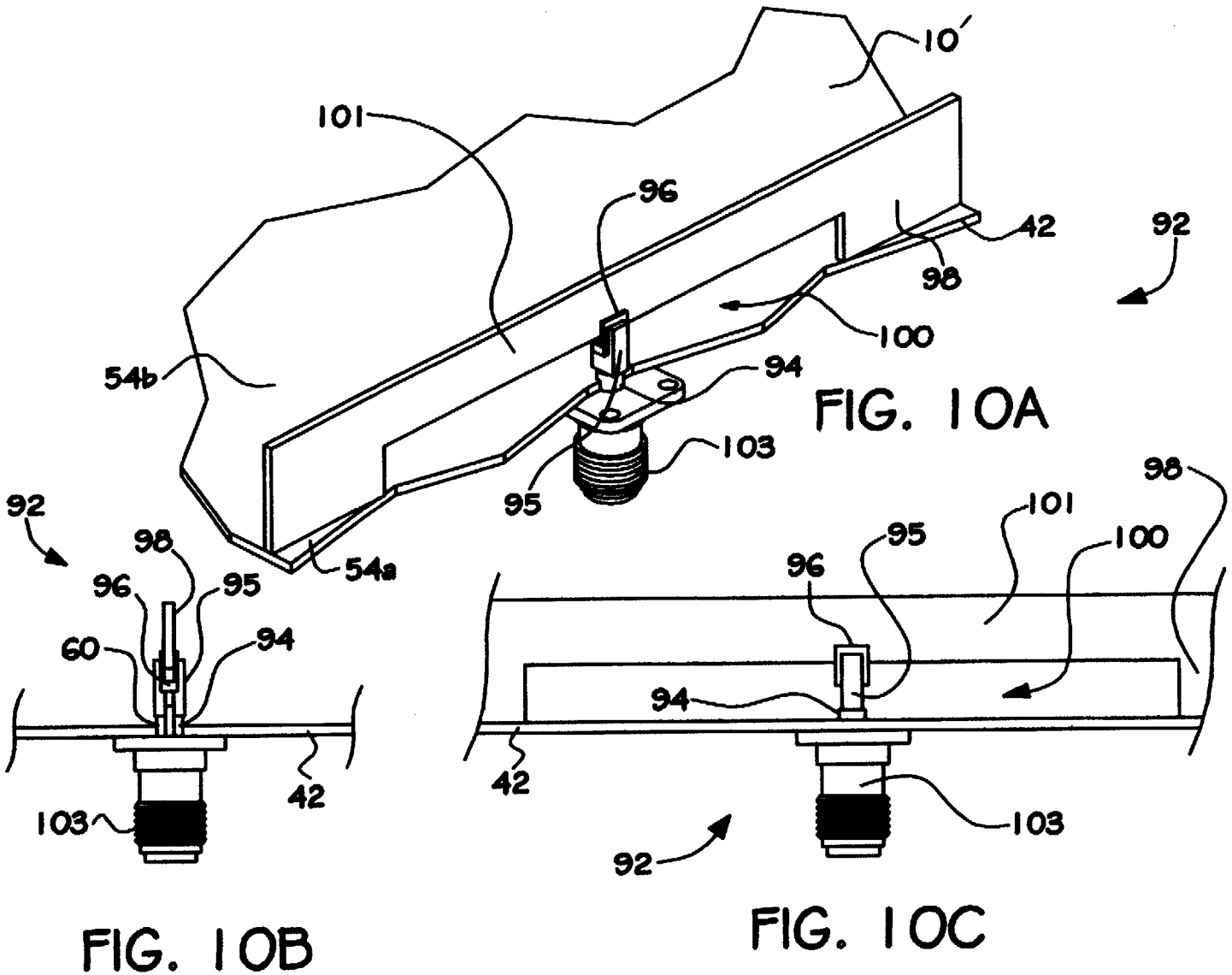
FIGS. 10A, 10B, and 10C, collectively described as FIG. 10, are illustrations showing a probe assembly within an operating environment of an antenna for an alternative embodiment of the present invention.
Figure 11B:
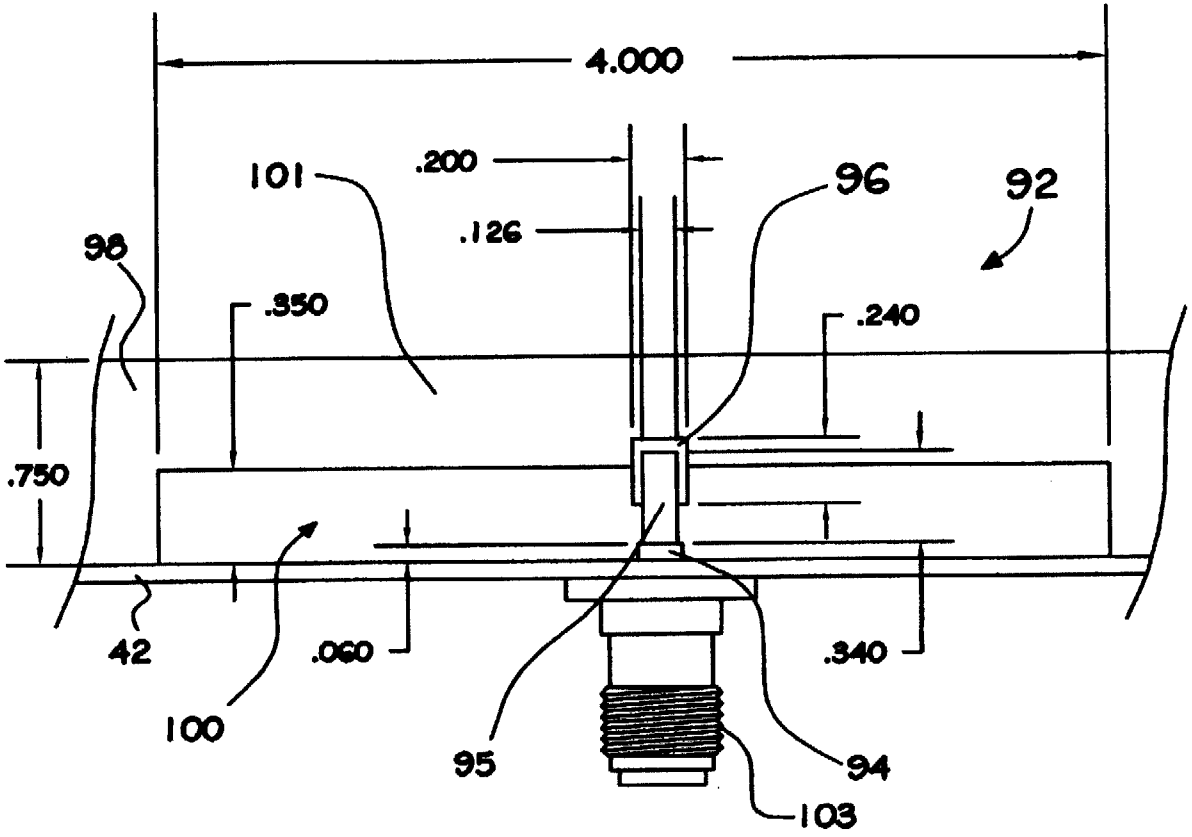
FIGS. 11A and B, collectively described as FIG. 11, are illustrations showing the dimensions of components of a probe assembly for an alternative embodiment of the present invention.
Figure 11A:
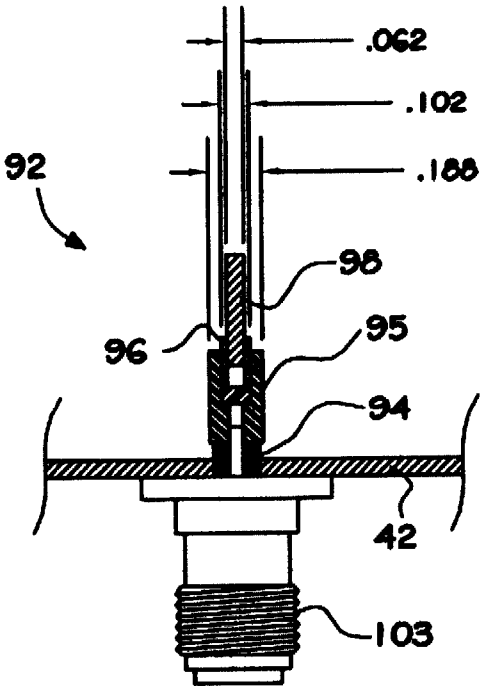

FIGS. 10A, B, and C, collectively described as FIG. 10, show the primary components of an alternative embodiment of a probe assembly for a slotted array antenna having a pair of symmetrically fed waveguide channels. FIGS. 11A and B, collectively described as FIG. 11, show cross sectional views of the alternative embodiment of the probe assembly. Specifically, FIG. 11A shows a cross sectional view taken along the width of the rear plate of the antenna, whereas FIG. 11B shows a cross sectional view taken along the length of the rear plate of the antenna. Turning now to FIGS. 10 and 11, for the antenna 10', a center bar between the waveguide channels 54*a* and 54*b* may be replaced by a much thinner bar, a center wall 98, having a thickness comparable to the thickness of the rear plate 42 or the face plate 44 (not shown). The center wall 98 is preferably connected along the central portion of the face plate and the rear plate by means of brazing, welding or laserwelding operations or by other equivalent means. Alternatively, the rear plate, face plate, and center wall 98 can be formed together as a single extrusion.

Within the cavity of the antenna 10', the centrally-located center wall 98 creates two waveguide channels 54*a* and 54*b*, wherein the center wall 98, the rear plate 42, and a face plate form the walls of the waveguide channels. Similar to the antenna 10, the waveguide channels 54*a* and 54*b* share a common wall represented by the center wall 98. The rear plate 42, the face plate, and the center wall 98 comprise conductive material, preferably aluminum sheeting.

The center wall 98 includes a center wall opening 100 that is preferably approximately ½ wavelength of the center frequency of the operating spectrum for the antenna 10'. The center wall opening 100 can be viewed as a cut-out or an opening taken from the mid-section of the center wall 98. The center wall opening 100 is placed along the length of the center wall 98 and preferably extends from the surface of rear plate 42 to the remaining portion of the center wall 98, a center wall segment 101.

A probe assembly 92 distributes RF energy to the waveguide channels 54*a* and 54*b* via an extension within the center wall opening 100 and, in turn, this RF energy is passed to the slots 56 (not shown). The probe assembly 92 is centrally located both with respect to the center wall 98 and to the waveguide channels 54*a* and 54*b*. The probe assembly 92 is preferably installed along the rear surface of the rear plate 42 and extends within the cavity of the antenna 10'via the probe opening 60 in the rear plate 42. This extension of the probe assembly 92 is implemented as a probe pin 94 comprising conductive material. In contrast to the antenna 10, the probe pin 94 preferably includes a tip having a fork-shaped probe tip 95, which can be attached to the tip by means of high temperature soldering, welding, or other suitable means, to effect both a structural and electrical connection. The probe tip 95 comprises two legs defining a distance extending across at least a space representing the thickness of the center wall segment 101. In this manner, the legs of the probe 94 form a U-shape prong or fork that extends upward from the probe tip 95, with an opening separating the probe tip legs. This allows the center wall 98 to be positioned within the two legs of the probe pin 94 for functionally connecting the probe tip 95 to the center wall 98.

The probe assembly 92 also can include an antenna connector 103, which supports a cabled-connection of RF energy between a transmit and/or receive source and the antenna 10. The antenna connector 103, which is typically implemented as a coaxial-type receptacle, such as a female N-type receptacle, can receive a male connector connected to feed cabling. The antenna connector 103 includes a center conductor that can be directly connected to the probe pin 94 or is implemented as an integral part of the probe pin 94. In this manner, RF energy can be distributed between the antenna connector 103 and the probe pin 94. The antenna connector 103 is typically connected to the surface of the rear plate 42 via fasteners, such as threaded mounting screws, thereby securing the probe assembly 92 to the antenna 10'.

The probe opening 60 is aligned with the midpoint of the center wall 98 to allow the probe pin 94 to enter the antenna cavity via the center wall opening 100. In particular, the probe pin 94, enters the probe opening 60 and passes through the center wall opening 100, thereby placing the probe tip 95 proximate to the sides of the center wall segment 101. Proper location and orientation of the probe pin 94 about the center wall 98 can be accomplished by interposing a dielectric segment 96 between the legs of the forked probe 94 and around the center wall 98. The dielectric segment 96 both provides dimensional stability to the elements of the probe assembly and effects a controlled shunt capacitance.

Focusing on the probe pin 94 in FIG. 10, the legs of the probe tip 95 are positioned adjacent to the dielectric segment 96. The U-shaped tip 95 functionally connects the probe pin 94 to the center wall and effectively clamps the dielectric segment 96 to the center wall segment 101. To accommodate the thickness of the dielectric segment 96, the legs of the probe tip 95 are preferably separated by a space defined by the combined width of the center wall and the dielectric segment. To preclude the generation of mechanical stresses on the assembly which might result from slight movement of center wall 98 relative to the probe assembly 92, the dielectric segment 96 is preferably attached by means of an adhesive to the legs of the probe pin 94, but is not directly attached to center wall 98.

The dielectric segment 96 can be used as a capacitive tuning element to adjust impedance matching characteristics of the probe assembly 92. This tuning feature also can be used to optimize performance over limited changes in operating frequency. The preferred dielectric material for dielectric segment 96 is "TEFLON". Alternative dielectric materials for the dielectric segment 96 include "ULTEM" or any low loss plastic material having low hygroscopic characteristic. Those skilled in the art will appreciate that the dielectric constant and the length of the dielectric segment 96 can be selected to achieve the desired impedance match.

The equivalent electrical circuit for the probe assembly is shown in FIG. 9, where four shunt impedances represent the two symmetrically-fed linear resonant slot arrays fed by the probe assembly 92 symmetrically located within the center wall opening. Referring to FIGS. 8 and 10–11, the probe assembly 92, similar to the probe assembly 46, can be schematically represented by an LC circuit comprising the L1 and C1 components, and the load associated with the waveguide channels **52*a* and 52*b* are schematically represented by four shunt impedances. By designing the physical dimensions of the probe pin 94 and that portion of the antenna assembly proximate to the probe assembly 92** to provide the appropriate values of the series inductance L1 and the shunt capacitance C1, the four waveguide shunt impedances can be matched to the desired 50 ohm transmission line impedance.

Preferred dimensions for elements of the probe assembly 92 are provided by the cross-sectional view shown in FIG. 11. Referring to FIG. 11, all dimensions supplied by these drawings are in inches. For the antenna 10' operating within the frequency range between 1420 MHz and 1530 MHz, as shown best in FIG. 11, the thickness of the center wall 40 is 0.062 inches; the center wall opening 100 is 0.350 inches wide and 4.0 inches long; the center wall segment 101 is 0.40 inches wide; the width and length of the legs of the probe tip 95 are respectively 0.126 inches and 0.340 inches; the width and length of the dielectric segment 96 are respectively 0.200 inches and 0.240 inches; the combined thickness of the dielectric segment 98 and the center wall segment 101 is 0.102 inches; and the combined thickness of both legs of the probe tip 95, the dielectric segment 98, and the center wall segment 101 is 0.188 inches.

An RF modeling tool, such as the HFSS modeling tool, is useful for designing physical dimensions of the probe assembly to accomplish the impedance match between the waveguide channel load and the transmission line impedance. Using the HFSS modeling tool, those skilled in the art can determine proper dimensions for the probe assembly 92, the length of the probe pin 94, the dimensions and dielectric constant of the dielectric segment 96, and the height and width of center wall opening 100.

As described above with respect to the antenna 10, it is important that the locations and sizes of the four most centrally located radiating slots **56*a*, 56*b*, 56*c*, and 56*d* (i.e. those four slots located most closely to probe assembly 102) should be adjusted to account for the distortion of RF energy distribution in the waveguide channels 54*a* and 54*b* which results from the presence of the probe assembly 92 and center wall opening 100**. This adjustment is preferably performed in conjunction with the determination of probe assembly dimensions with the use of HFSS or equivalent modeling tools.

Those skilled in the art will appreciate that the performance of the symmetrical feed approach presented by the alternative probe assembly 92 relies upon the symmetrical location of the probe pin 94 and the dielectric tuning element 96 with respect to one another and to both the center wall 98 and the center wall opening 101. This symmetrical design approach for the probe assembly 92 is critical for providing equal phase and amplitude RF signals to each quadrant of the waveguide sticks **52*a* and 52*b***.

Similar to the antenna 10, it will be appreciated that some frequency scaling of the dimensions for the probe assembly 92 in FIGS. 10–11 is possible. However, many of the dimensions which control impedance matching reflect reactive interaction among surfaces, as contrasted with matching based on the use of quarter-wavelength section rotations to accomplish phase cancellation. For this reason, those skilled in the art will appreciate that design dimensions for the preferred probe assembly at frequencies distant from 1500 MHz will not scale well, and that the use of HFSS or equivalent conventional modeling tools will be required to implement the preferred probe assembly at those other frequencies.

One of the advantages of the antenna and associated probe assembly provided by the present invention is that the antenna 10 is amenable to manufacturing and assembly at very low cost. The preferred manufacturing process for the antenna 10 is shown in FIGS. 12–19. All dimensions provided by FIGS. 12–19 are in inches. Turning now to FIGS. 2, 6, and 12–19, the manufacturing process starts with appropriate raw materials available for construction of the antenna 10.

Figures 12A, 12B, 12C, 12D:
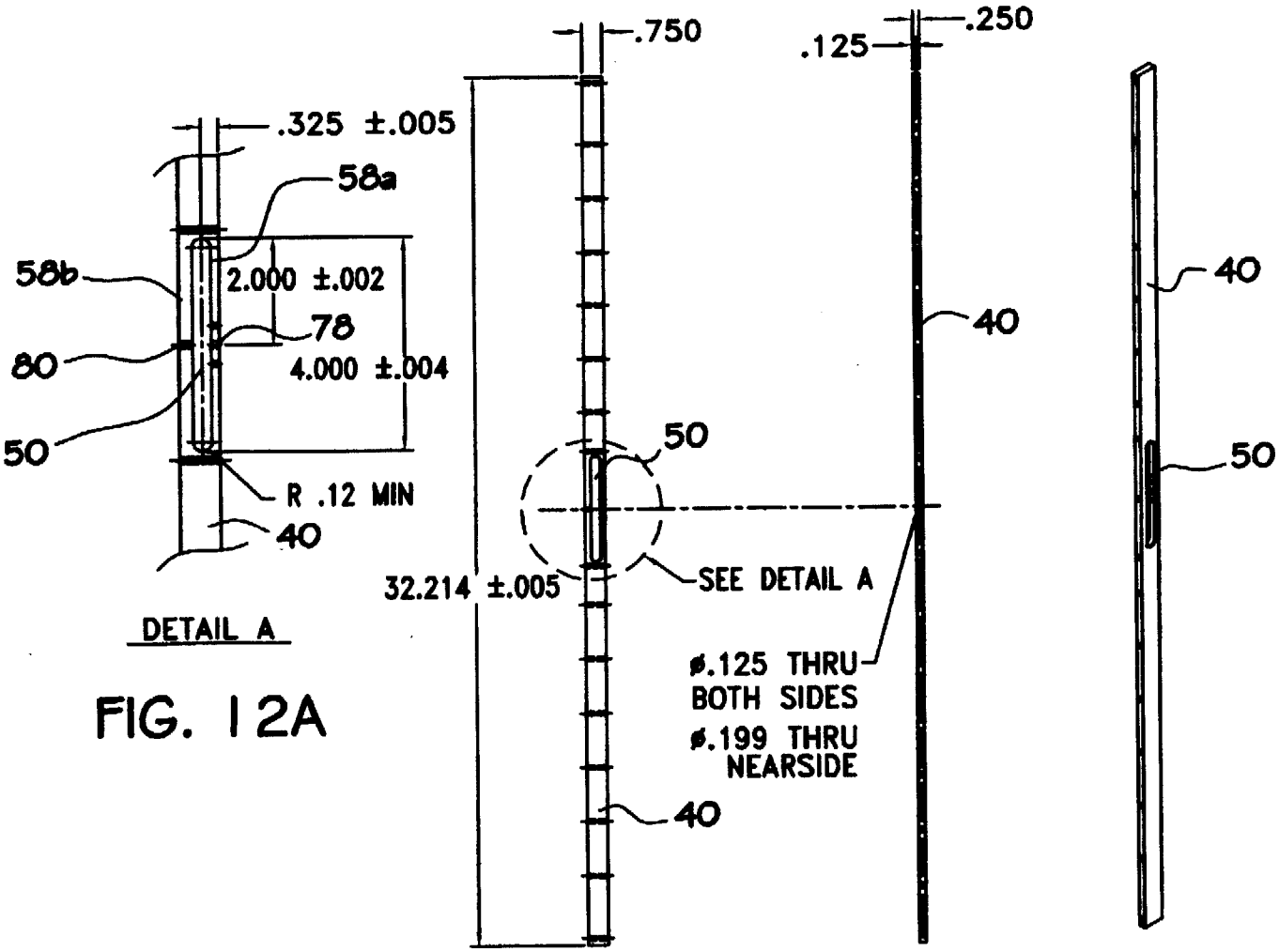
FIGS. 12A, 12B, 12C, and 12D, collectively described as FIG. 12, are illustrations respectively showing a side view of the a center bar opening of a center bar, a side view of the center bar, an edge view of the center bar, and a perspective view of the center bar for the preferred embodiment of the present invention.

As shown in FIG. 12, the center bar 40 is machined from 6061-T6 aluminum, ¼×¾ inches, rectangular extruded bar stock. The center bar opening 50, first cylindrical hole 78, and second cylindrical hole 80 are machined within a central portion of the center bar 40. In addition, thru-holes to accommodate the rivets 52 are machined along the length of the center bar 40. Tapped holes to accommodate the fasteners 76 for installing the probe assembly 46 are also machined into a central portion of the center bar 40. In particular, these tapped holes are machined along the center bar section **54*a***.

Figures 13A, 13B, 13C:
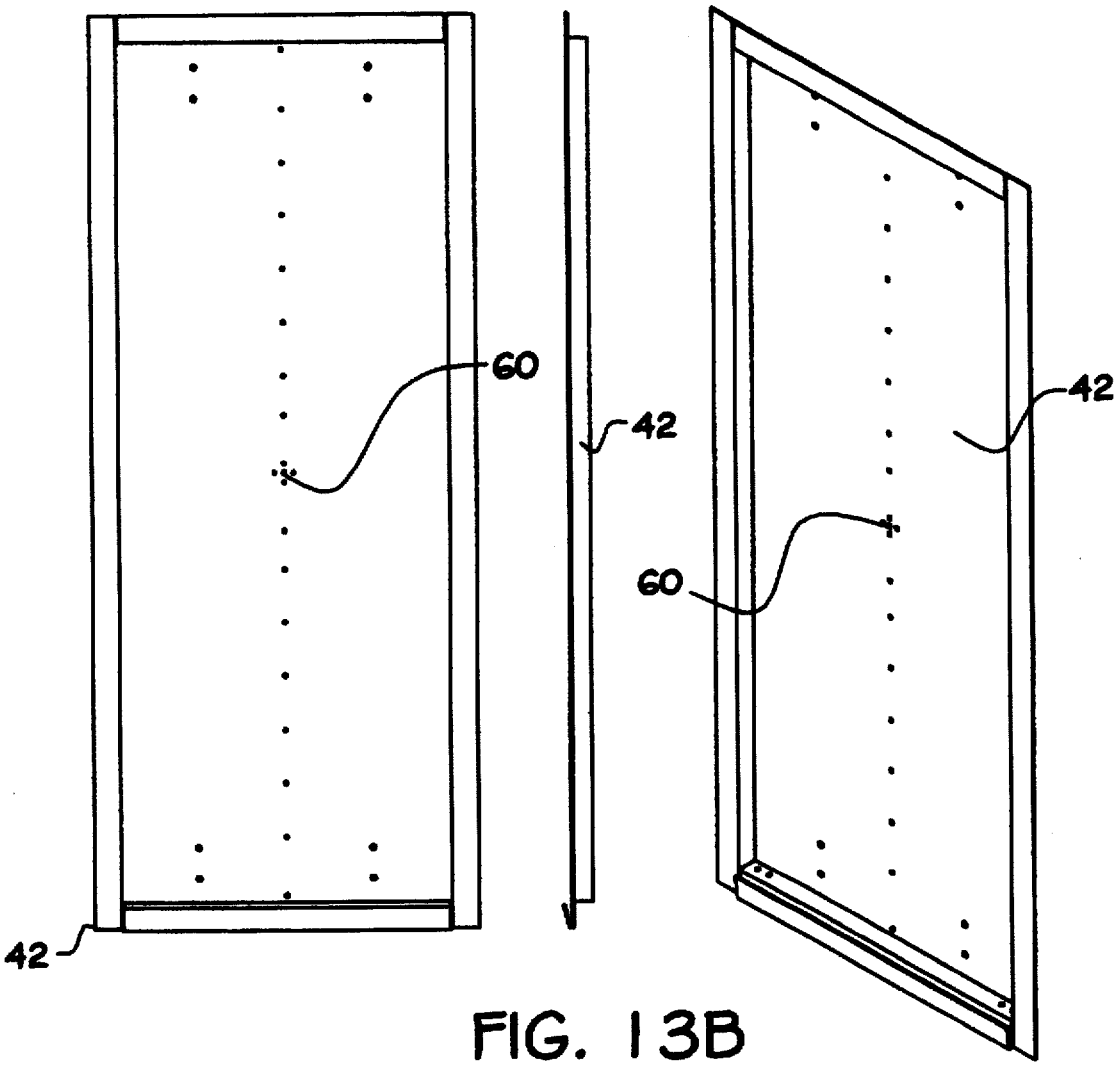
FIGS. 13A, 13B, and 13C, collectively described as FIG. 13, are illustrations respectively showing a front view, a side view, and a perspective view of the rear plate for the preferred embodiment of the present invention.

Turning now to FIG. 13, the rear plate 42 is stamped from flat sheet metal stock, preferably 0.062 thick aluminum 3003-H14. Holes to accommodate the probe assembly 46, including the probe hole 60, and the installation holes for the rivets 52 are punched into the rear plate 42. In turn, the edges of the rear plate 42 are folded to form a tray, as shown in FIGS. 13B and C. The tray has a depth sufficient to accept the center bar 40 when the length of the center bar is placed along the floor of this tray. It will be understood that the waveguide channels 54*a* and 54*b* are created by securing the center bar 50 to the floor of the tray provided by the rear plate 42, and thereafter attaching the face plate 44 to the rear plate 42.

One edge along the minor dimension of the rear plate 42 is also folded at a predetermined angle to fold this edge upon itself, as best shown in FIGS. 13B and 13C. An edge of the face plate 44 will eventually be placed within this folded minor dimension edge of the rear plate 42.

Figure 14B:
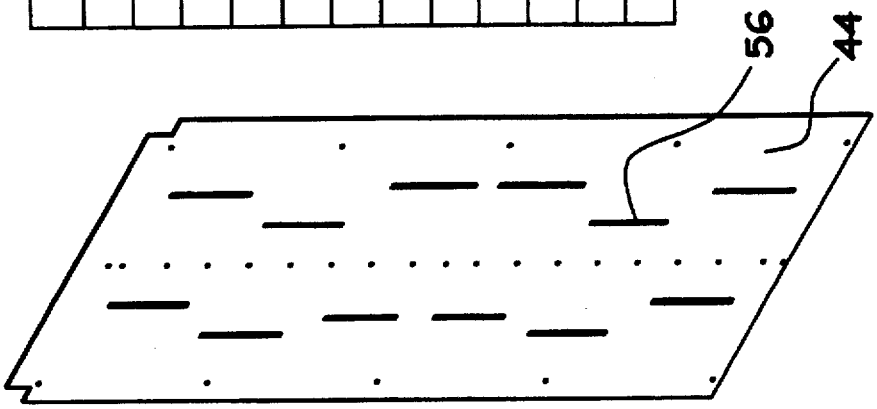
FIGS. 14A and 14B, collectively described as FIG. 14, are illustrations respectively showing a front view of the slot placement within a face plate and a perspective view of the slot placement within the face plate of the preferred embodiment of the present invention.
Figure 14A:
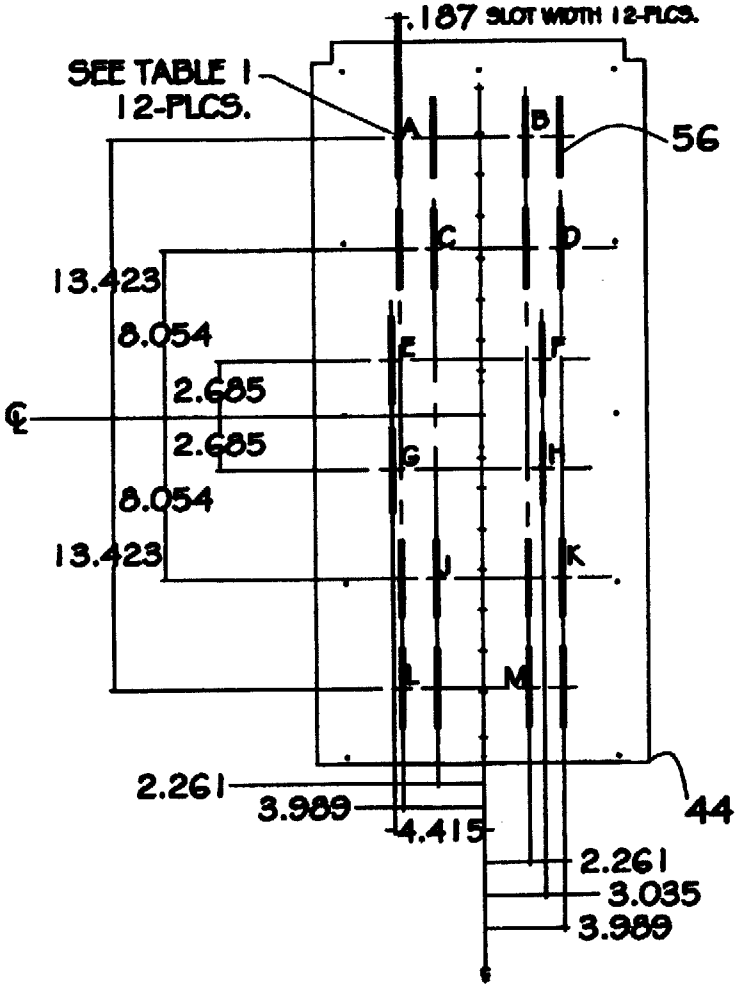
Figures 15A, 15B, 15C, 15D:
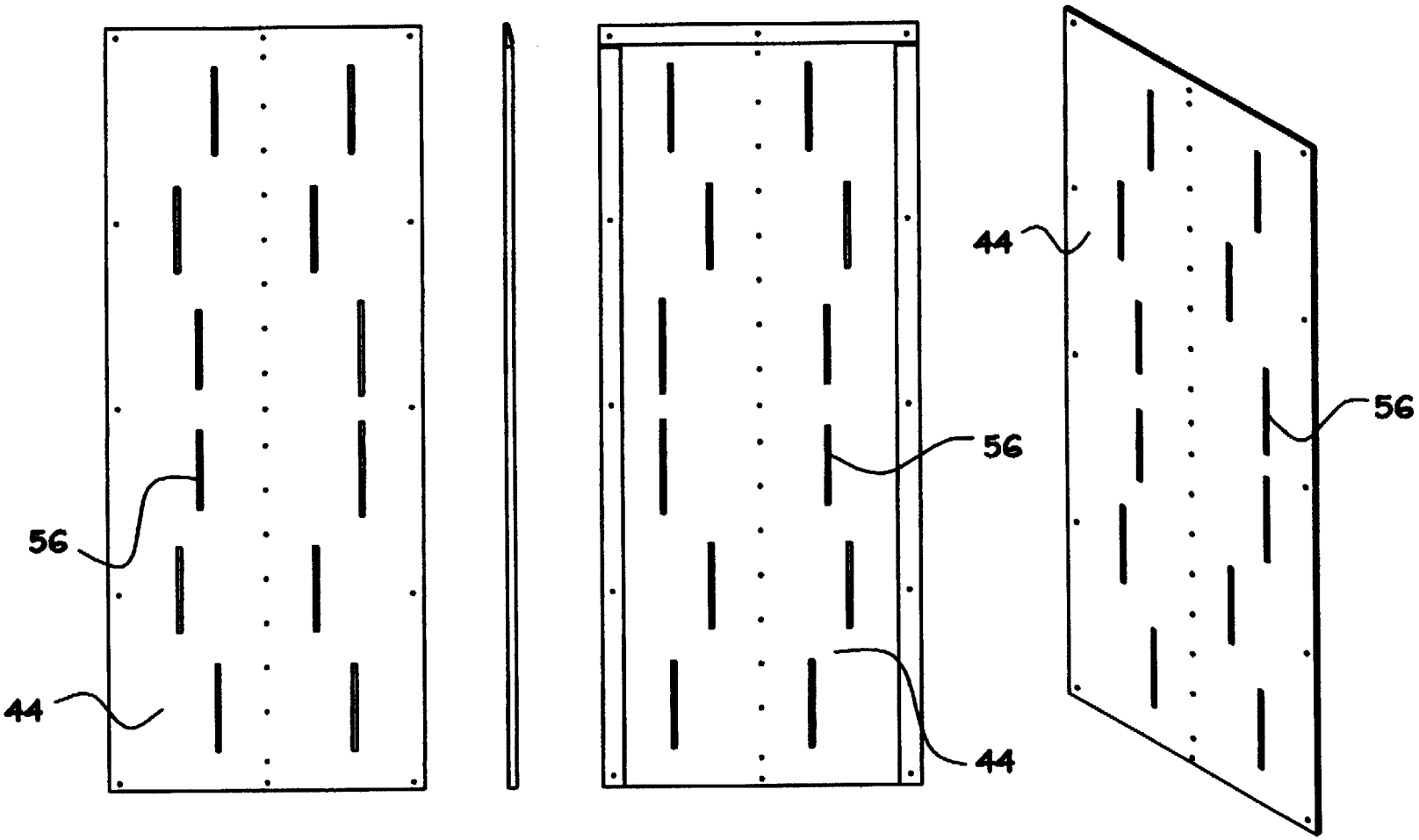
FIGS. 15A, 15B, 15C, and 15D, collectively described as FIG. 15, are illustrations respectively showing a front view and a side view of a face plate, a front view of a rear plate, and a perspective view of the face plate for the preferred embodiment of the present invention.

Referring now to FIGS. 14 and 15, the face plate 44 is stamped from flat sheet metal stock, preferably 0.062 thick aluminum 3003-H14. Similar to the rear plate 42, holes to accommodate the rivets 52 are punched into the face plate 44. In addition, the slots 56 are punched into the face plate 44, as best illustrated in FIG. 14A. An edge along a minor dimension of the face plate 44 is folded at a predetermined angle to produce a folded minor dimension edge of the face plate. An edge along to the minor dimension of the rear plate 42 will eventually be placed within this folded minor dimension edge of the face plate 44. Similarly, an edge along each major dimension of the face plate 44 is folded at a predetermined angle to produce folded major dimension edges of the face plate. The folded edges of the face plate 44 are best shown in FIG. 15B (folded minor dimension edge) and FIG. 15C (folded minor and major dimension edges).

Figure 16:
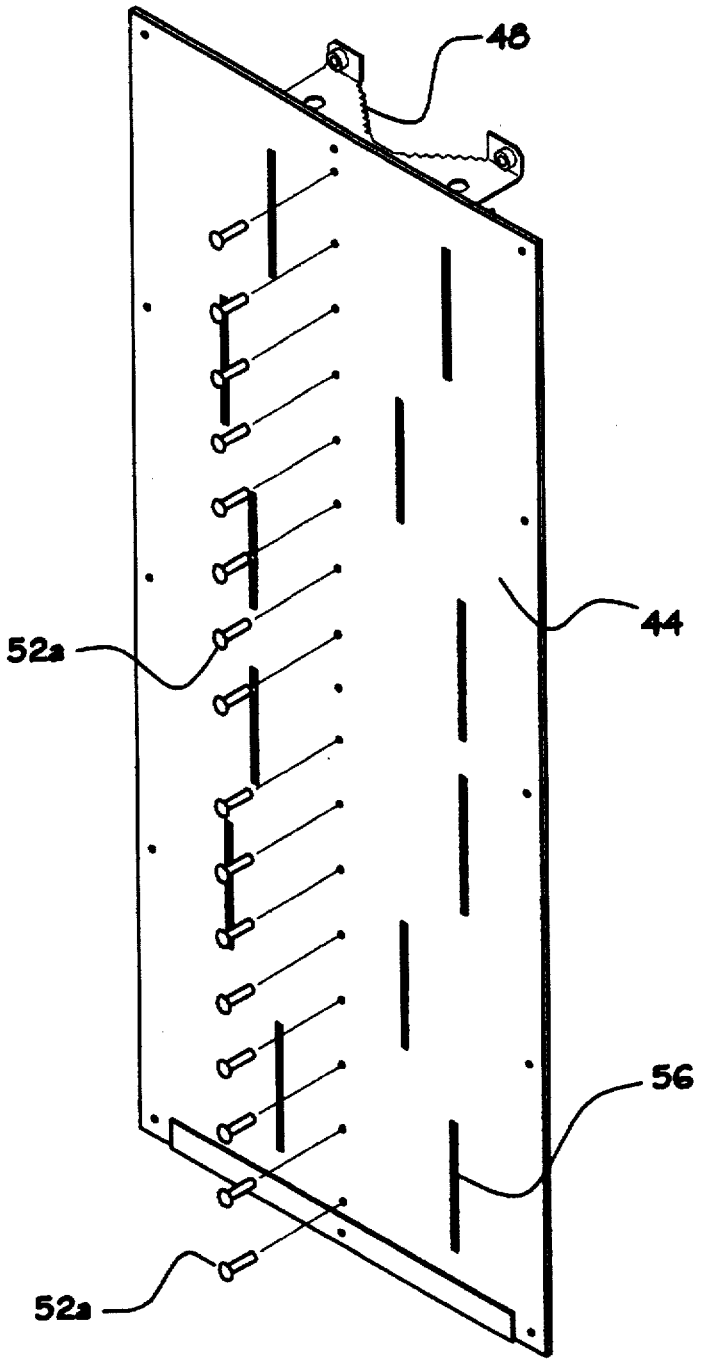
FIG. 16 is an illustration showing placement of rivets along the center portion of a face plate of the preferred embodiment of the present invention.
Figure 17:
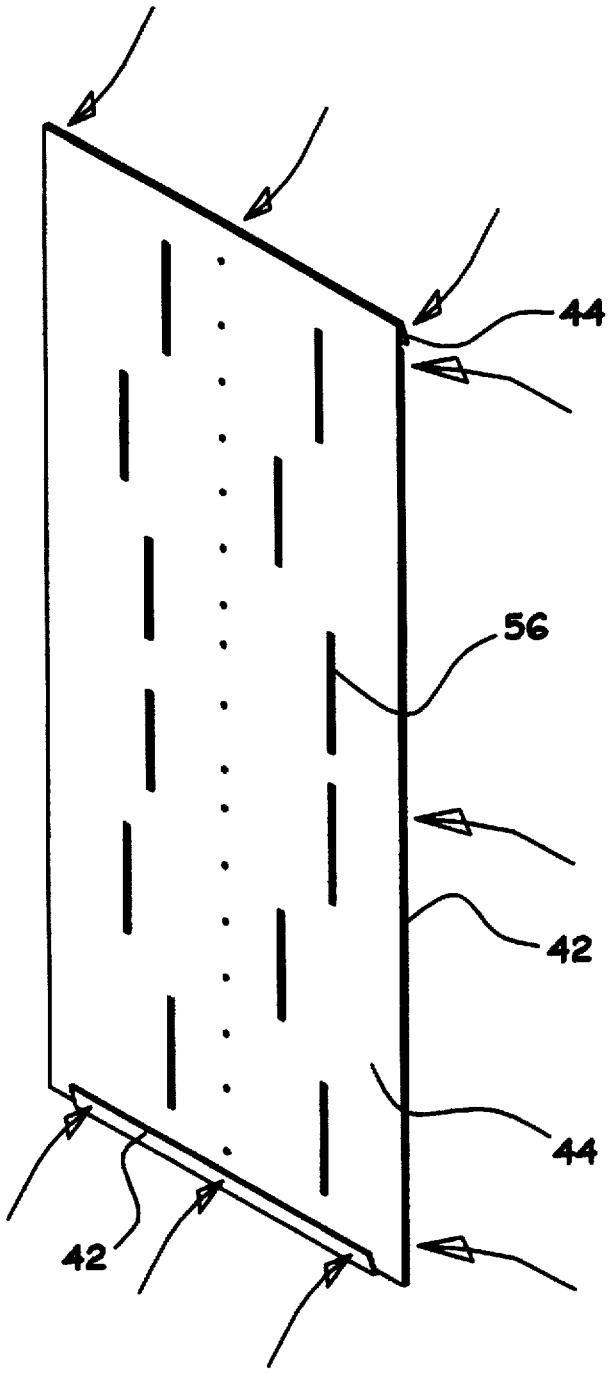
FIG. 17 is an illustration showing crimped edges of a face plate of the preferred embodiment of the present invention.
Figure 18:
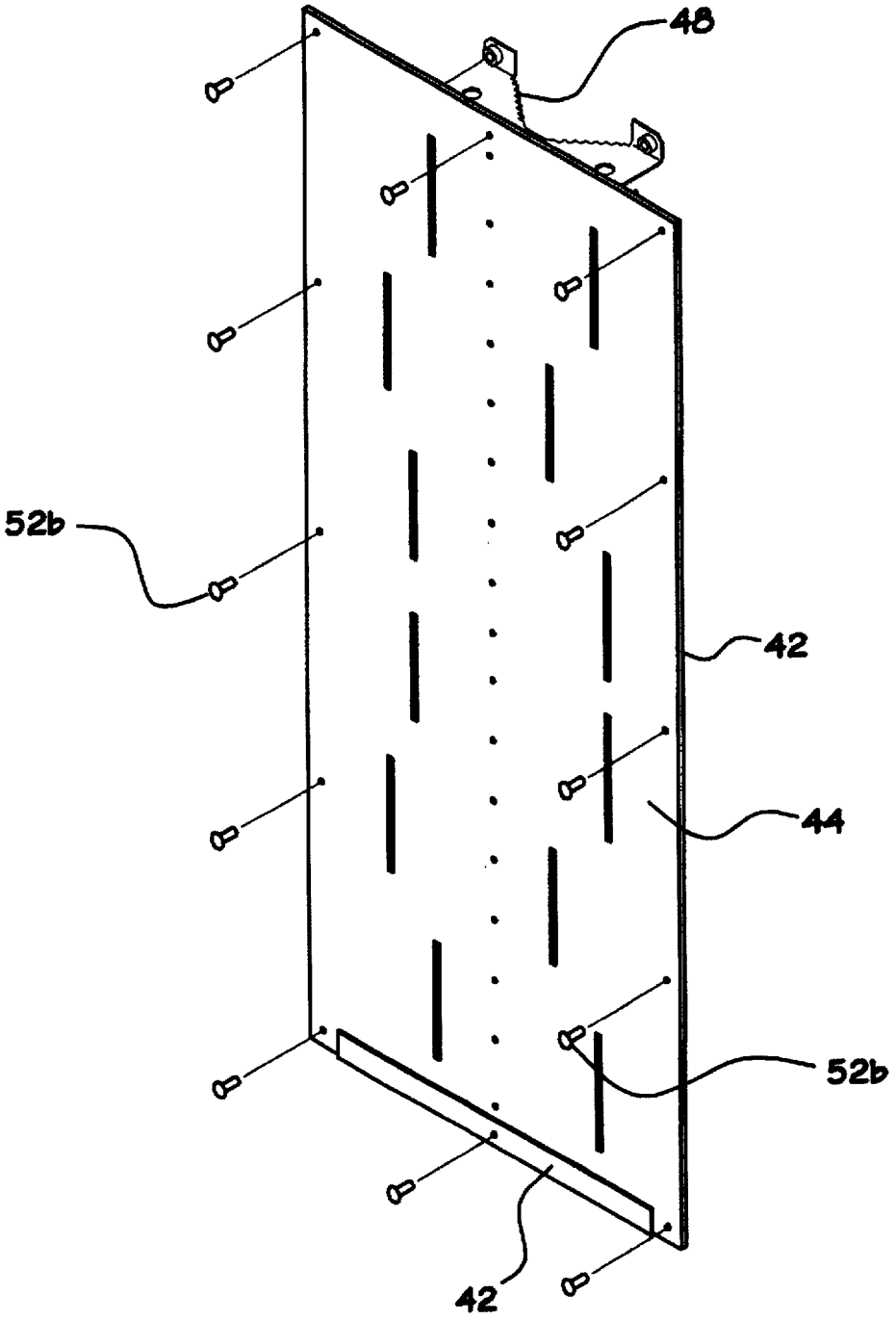
FIG. 18 is an illustration showing placement of rivets along the periphery of a combination of a face plate and a rear plate of the preferred embodiment of the present invention.

Referring to FIGS. 16, 17, and 18, the face plate 44 is slid into place along the top surface of the rear plate 42, as the center bar 40 is installed between the two. The two plates are joined by sliding the single non-folded minor dimension edge of the face plate 44 toward the folded minor dimension edge of the rear plate 42, while the major dimension edges of the rear plate 42 are placed within the folded major dimension edges of the face plate 44. By placing the single non-folded minor dimension edge of the face plate 44 within the folded minor dimension edge of the rear plate 42, the non-folded minor dimension edge of the rear plate 42 can be positioned within the folded minor dimension edge of the face plate 44 when the face plate 44 is substantially parallel and adjacent to the rear plate 32.

To precisely locate and orient the face plate 44, the rear plate 42, and the center bar 40 relative to one another, temporary pins are installed at the top, center and bottom of the assembly in the rivet holes along the region of the center bar 40. As shown in FIG. 16, rivets 52*a* are then installed through the rear and the face plates 42 and 44 along the center bar 40 while the temporary pins fix their relative positions and orientations. Focusing on FIG. 17, the folded minor dimension edge of the rear plate 42 and the folded minor and major dimension edges of the face plate 44 are tightly folded or crimped, thereby supporting the mounting of the face plate 44 to the rear plate 42 along the periphery of the antenna assembly. As best viewed in FIG. 18, additional rivets 52*b*, which have a different length from the rivets 52*a*, then can be installed along the periphery of the antenna assembly to tightly secure the face plate 44 to the rear plate 42. The entire antenna assembly, as exists at this stage of the assembly process, is preferably iridited and painted for corrosion protection.

The probe assembly 46, which preferably includes the antenna connector 64, is installed through the probe hole 60 on the rear plate 42 and into the guidance hole 68 of the center bar 40. In particular, the center conductor of the antenna connector 64 is placed through the probe hole 60 and into the guidance hole 68. The antenna connector 64, such as an N-type receptacle, is attached to the exterior surface of the rear plate 42 using fasteners 76 (2 each), preferably #4 mounting screws, which extend through clearance holes in the rear plate 42 and into tapped holes in the center bar 40. Two additional fasteners 76 are installed in the remaining holes of the antenna connector 64, preferably #4 screws, which thread into a pair of corresponding tapped holes in the rear plate 42. The fasteners 76 are preferably staked using a suitable compound.

If required, tuning may be performed to optimize the impedance match of probe assembly 46 by adjustment of the position of dielectric tuning element 74 along the probe pin 62. Once optimum tuning has been established, the position of dielectric tuning element 74 along probe pin 62 may be fixed by application of a suitable epoxy.

Figure 19:
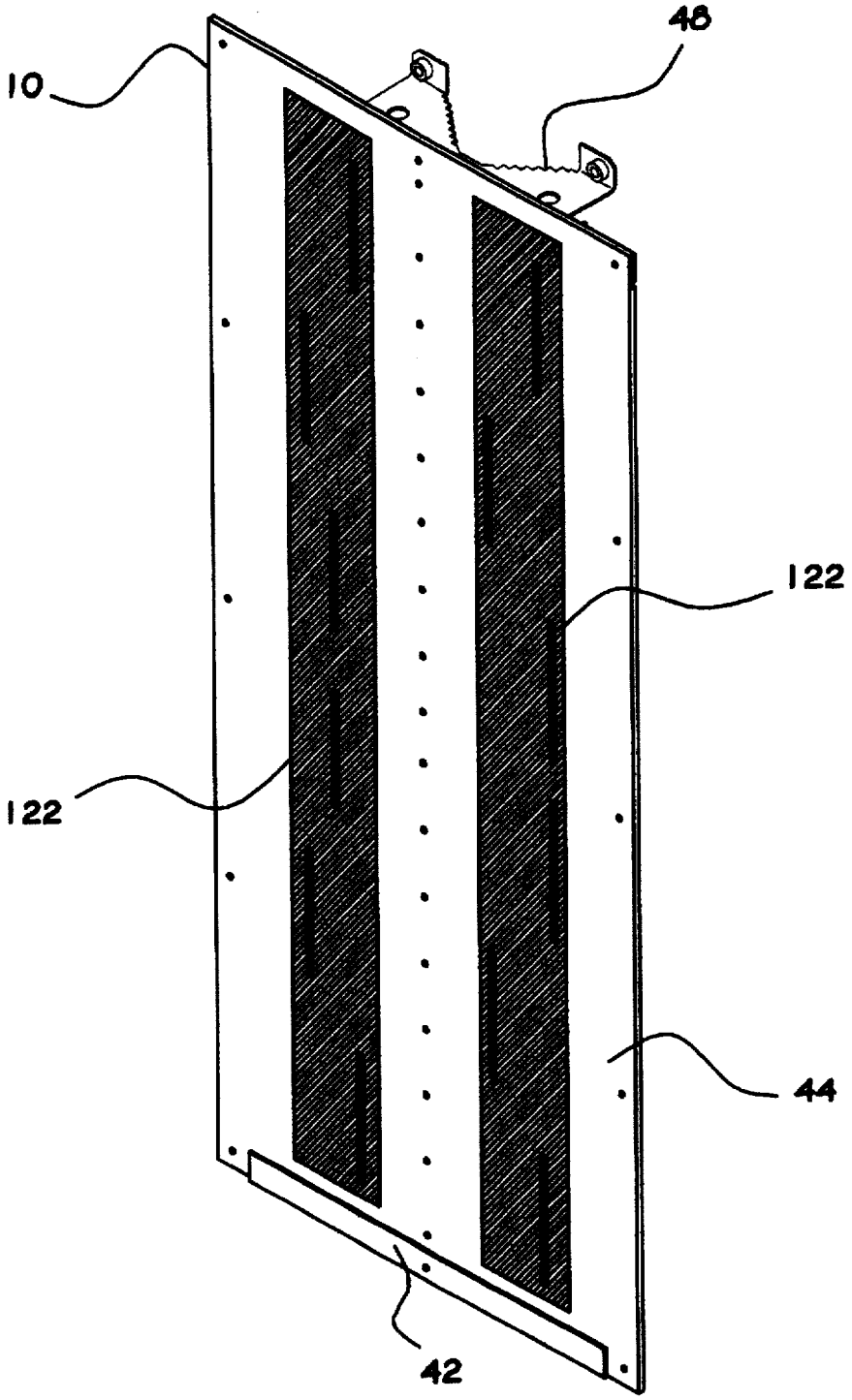
FIG. 19 is an illustration showing placement of strips of radiating tape along slots of a face plate of the preferred embodiment of the present invention.

Turning now to FIG. 19, weather-resistant, film tape 122, preferably "SCOTCH" brand 838 by 3M Company, is applied to the face plate 44 to cover the slots 56. This protects the interior of the antenna 10 from exposure to the environment and from nesting insects.

Those skilled in the art will recognize that the use of sheet metal fabrication techniques such as punching and folding may be substantially more cost-effective than prior art planar slot array antenna manufacturing approaches, including use of extruded components and machining of radiating slots.

In summary, the present invention provides a distribution network having a single probe element to distribute radio frequency (RF) energy to and from a waveguide-implemented planar array of slot elements. The slotted array antenna includes an antenna body, comprising conductive material, having a cavity surrounded by intersecting wall segments. The wall segments include (1) rear plate and (2) a face plate having a planar array of longitudinal radiating slot elements, and both plates are positioned in spaced-apart parallel planes. The antenna further includes a center bar, centrally placed between the face plate and the rear plate, to form within the cavity a parallel pair of waveguide channels or sticks.

The center bar has a center bar opening extending longitudinally along a portion of the center bar, thereby separating the center bar portion into first and second center bar segments. The center bar opening is positioned at the approximate midpoint of the center bar, extends for a length of approximately ½ wavelength along the center bar, and is parallel to both the face plate and the rear plate. A guidance hole is aligned with an edge of the center bar and extends through the first center bar segment and at least a portion of the second center bar segment.

A probe assembly distributes radio frequency (RF) energy in substantially equal phase and amplitude to the waveguide channels via the center bar opening. The probe assembly includes a probe pin, which is preferably the center conductor of an antenna connector attached to the rear plate. The probe pin is inserted within the guidance hole and passes through both the first center bar segment and the center bar opening and into the portion of the second center bar segment. The geometry of the probe design supports the coupling of the RF energy to the center bar opening and into each of the quadrants represented by the pair of waveguide channels.

The present invention provides the advantages of a low profile antenna having significant gain and the ability to withstand wind, rain and other environmental stresses. The antenna is relatively easy to install and offers the economical advantages of minimum material costs, minimum fabrication costs, and minimum assembly costs. Significantly, the present invention is implemented as a slotted array antenna and incorporates a single feedpoint that replaces the waveguide or microstrip feed structures utilized in prior antennas, and provides a manufacturing is approach that can rely upon simple, cost-effective sheet metal manufacturing processes.

While the present invention is susceptible to various modifications and alternative forms, a preferred embodiment has been depicted by way of example in the drawings and will be further described in detail. It should be understood, however, that it is not intended to limit the scope of the present invention to the particular embodiments described. On the contrary, the intention is to cover all modifications, equivalents, and alternatives falling within the spirit and scope of the invention as defined by the appended claims.

We claim:

1. An antenna, comprising:

an antenna body, comprising a conductive material, having a cavity surrounded by a plurality of intersecting wall segments, at least two of the wall segments including (1) a rear plate and (2) a face plate having a planar array of longitudinal slots, the rear plate and the face plate positioned in spaced-apart parallel planes, and a center bar, centrally placed between the face plate and the rear plate and extending along the length of the antenna, the center bar physically contacting the face plate and the rear plate so as to form within the cavity a parallel pair of waveguide channels, the center bar comprising a center bar opening extending longitudinally along a portion of the center bar and separating the center bar portion into first and second center bar segments, and a guidance hole aligned with one edge of the center bar and extending through the first center bar segment and at least a portion of the second center bar segment; and a probe for distributing radio frequency (RF) energy in substantially equal phase and amplitude to the waveguide channels via the center bar opening, the probe comprising a probe pin, inserted within the guidance hole and passing through both the first center bar segment and the center bar opening and into the portion of the second center bar segment, for coupling the RF energy to the center bar opening.

2. The antenna of claim 1 further comprising a dielectric tuning element, located within the guidance hole in the second center bar segment, the dielectric tuning element positioned adjacent to a tip of the probe pin, for adjusting the impedance presented by the probe to the waveguide channels.

3. The antenna of claim 2, wherein the dielectric tuning element comprises an air gap between the tip of the probe pin and an enclosed end of the guidance hole within the second center bar segment.

4. The antenna of claim 2, wherein the dielectric tuning element comprises a sleeve of dielectric material placed around the periphery of the tip of the probe pin.

5. The antenna of claim 1 further comprising an antenna connector, mounted to the rear plate and electrically connected to the probe via an opening within the rear plate and aligned with the guidance hole, comprising a center conductor for transporting the RF energy to and from the probe.

6. The antenna of claim 5, wherein the probe pin comprises the center conductor of the antenna connector.

7. The antenna of claim 1, wherein the length of the center bar opening is defined by approximately ½ wavelength of a center frequency of operation for the antenna.

8. The antenna of claim 1, wherein the center bar opening is positioned at the approximate midpoint of the center bar and is substantially parallel to both the face plate and the rear plate.

9. The antenna of claim 1, wherein the probe presents a desired impedance to the waveguide channels and distributes equal amplitude and phase RF energy to each of four quadrants formed by the pair of waveguide channels.

10. The antenna of claim 1 further comprising an electronic module connected to the rear plate of the antenna, the electronic module electrically connected to the probe pin of the probe and including at least one of a receiver for receiving RF energy and a transmitter for transmitting RF energy.

11. For an antenna comprising an antenna body of conductive material, the antenna body having a cavity surrounded by a plurality of intersecting wall segments, at least two of the wall segments including (1) a rear plate and (2) a face plate having a plurality of slots, the rear plate and the face plate positioned in spaced-apart parallel planes, and a center bar, centrally placed between the face plate and the rear plate, and physically contacting the face plate and the rear plate so as to form within the cavity a pair of waveguide channels, the center bar comprising a center bar opening extending longitudinally along a portion of the center bar and separating the portion of the center bar into first and second center bar segments, and a guidance hole aligned with one edge of the center bar and extending through the first center bar segment and at least a portion of the second center bar segment, a single probe for distributing radio frequency (RF) energy to the waveguide channels, comprising:

a probe pin, inserted within the guidance hole and passing through both the first center bar segment and the center bar opening and into the portion of the second center bar segment, for coupling the RF energy to the center bar opening, thereby distributing the RF energy in substantially equal phase and amplitude to the waveguide channels.

12. The antenna of claim 11 further comprising a dielectric tuning element, located within the guidance hole in the second center bar segment, the dielectric tuning element positioned adjacent to a tip of the probe pin, for adjusting the impedance presented by the probe to the waveguide channels.

13. The probe of claim 12, wherein the dielectric tuning element comprises an air gap between the tip of the probe pin and an enclosed end of the guidance hole within the second center bar segment.

14. The probe of claim 12, wherein the dielectric tuning element comprises a sleeve of dielectric material placed around the periphery of the tip of the probe pin.

15. The probe of claim 11, wherein the antenna comprises an antenna connector, mounted to the rear plate and electrically connected to the probe via an opening within the rear plate and aligned with the guidance hole, having a center conductor for transporting the RF energy to and from the probe, wherein the probe pin of the probe comprises the center conductor of the antenna connector.

16. The antenna of claim 11, wherein the center bar opening is positioned at the approximate midpoint of the center bar and is substantially parallel to both the face plate and the rear plate, and the length of the center bar opening is defined by approximately ½ wavelength of a center frequency of operation for the antenna.

17. A slotted array antenna, comprising:

an antenna body, comprising a conductive material, having a cavity surrounded by a plurality of intersecting wall segments, at least two of the wall segments including (1) a rear plate and (2) a face plate having a plurality of slots, the rear plate and the face plate positioned in spaced-apart parallel planes, and a center bar, centrally placed between the face plate and the rear plate, to form within the cavity a pair of waveguide channels separated by the center bar, the center bar comprising a center bar opening extending longitudinally along at least a portion of the center bar and separating the portion of the center bar into first and second center bar segments, and a guidance hole aligned with one edge of the center bar and extending through the first center bar segment and at least a portion of the second center bar segment;

a probe for distributing radio frequency (RF) energy in substantially equal phase and amplitude to the waveguide channels via the center bar opening; and an antenna connector, mounted to the rear plate and electrically connected to the probe, comprising a center conductor for transporting the RF energy to and from the probe, the probe comprising:

the center conductor of the antenna connector, inserted within the guidance hole and passing through both the first center bar segment and the center bar opening and into the portion of the second center bar segment, for coupling the RF energy to the center bar opening; and a dielectric tuning element, located within the guidance hole and within the portion of the second center bar segment, the dielectric tuning element positioned adjacent to a tip of the center connector, for adjusting the impedance presented by the probe.

18. The antenna of claim 17, wherein the dielectric tuning element comprises an air gap between the tip of the probe pin and an enclosed end of the guidance hole within the second center bar segment.

19. The antenna of claim 17, wherein the dielectric tuning element comprises a sleeve of dielectric material placed around the periphery of the tip of the probe pin.

20. The antenna of claim 17, wherein the center bar opening is positioned at the approximate midpoint of the center bar and is substantially parallel to both the face plate and the rear plate, and the length of the center bar opening is defined by approximately ½ wavelength of a center frequency of operation for the antenna.

21. A slotted antenna, comprising:

an antenna body, comprising a conductive material, having a cavity surrounded by a plurality of intersecting wall segments, at least two of the wall segments including (1) a rear plate and (2) a face plate having a plurality of slots, the rear plate and the face plate positioned in spaced-apart parallel planes, and a center wall, centrally placed between the face plate and the rear plate, and physically contacting the face plate and the rear plate so as to form within the cavity a pair of waveguide channels, a portion of the center wall comprising a center wall opening extending longitudinally along the center wall portion and a center wall segment defining the remaining segment of the center wall portion; and a probe for distributing radio frequency (RF) energy in substantially equal phase and amplitude to the waveguide channels via the center wall opening, the probe comprising a probe pin, inserted within the center wall opening and functionally connected to the center wall segment for coupling the RF energy to the center wall opening.

22. The antenna of claim 21, wherein a tip of the probe pin has a pair of legs separated by a space defined by the width of the center wall segment, the legs positioned along sides of the center wall segment to functionally connect the probe pin to the center wall.

23. The antenna of claim 21 further comprising a dielectric segment, functionally connected to a tip of the probe pin, for adjusting the impedance presented by the probe to the waveguide channels, the dielectric segment positioned proximate to each side of the center wall segment and adjacent to the center wall opening.

24. The antenna of claim 23, wherein the tip of the connector has a pair of legs separated by a space defined by the combined width of the center wall segment and the dielectric segment, the legs positioned adjacent to the dielectric segment to functionally connect the probe pin to the center wall and to clamp the dielectric segment to the center wall segment.

25. The antenna of claim 21 further comprising an antenna connector, mounted to the rear plate and electrically connected to the probe via an opening positioned within the rear plate and aligned with the guidance hole, comprising a center conductor for transporting the RF energy to and from the probe.

26. The antenna of claim 25, wherein the probe pin comprises the center conductor of the antenna connector.

27. The antenna of claim 21, wherein the center wall opening is positioned at the approximate midpoint of the center wall and is substantially parallel to both the face plate and the rear plate, and the length of the center wall opening is defined by approximately ½ wavelength of a center frequency of operation for the antenna.

28. The antenna of claim 21, wherein the probe presents a desired impedance to the waveguide channels and distributes equal amplitude and phase RF energy to each of four quadrants formed by the pair of waveguide channels.

29. The antenna of claim 21 further comprising an electronic module connected to the rear plate of the antenna, the electronic module electrically connected to the probe pin of the probe and including at least one of a receiver for receiving RF energy and a transmitter for transmitting RF energy.

30. In a slotted antenna having an antenna body, comprising a conductive material, having a cavity surrounded by a plurality of intersecting wall segments, at least two of the wall segments including (1) a rear plate and (2) a face plate having a plurality of slots, the rear plate and the face plate positioned in spaced-apart parallel planes, and a center wall, centrally placed between the face plate and the rear plate, to form within the cavity a pair of waveguide channels, at least a portion of the center wall comprising a center wall opening extending longitudinally along the center wall portion and a center wall segment defining the remaining segment of the center wall portion, a probe for distributing radio frequency (RF) energy in substantially equal phase and amplitude to the waveguide channels via the center wall opening, the probe comprising:

a dielectric segment for adjusting the impedance presented by the probe to the waveguide channels, the dielectric segment positioned proximate to each side of the center wall segment and adjacent to the center wall opening;

a probe pin, inserted within the center wall opening and functionally connected to the center wall segment for coupling the RF energy to the center wall opening, the connector having a tip including a pair of legs separated by at least the space defined by the width of a combination of the center wall segment and the dielectric segment, the legs positioned along sides of the center wall segment to clamp the dielectric segment between the tip of the probe pin and the center wall.

31. The probe of claim 30, wherein the antenna comprises an antenna connector, mounted to the rear plate and electrically connected to the probe via an opening positioned within the rear plate and aligned with the guidance hole, having a center conductor for transporting the RF energy to and from the probe, the probe pin comprising the center conductor of the antenna connector.

32. The probe of claim 30, wherein the center wall opening is positioned at the approximate midpoint of the center wall and is substantially parallel to both the front plate and the rear plate, and the length of the center wall opening is defined by approximately ½ wavelength of a center frequency of operation for the antenna.

33. The probe of claim 30, wherein the probe presents a desired impedance to the waveguide channels and distributes equal amplitude and phase RF energy to each of four quadrants formed by the pair of waveguide channels.

34. The probe of claim 30, wherein the antenna comprises an electronic module connected to the rear plate of the antenna, the electronic module including a receiver and a transmitter, each electrically connected to the probe pin of the probe for respectively receiving and transmitting signals of the RF energy.

35. A method for manufacturing an antenna having a rear plate, a face plate, a center bar separating a cavity formed by an intersection of the rear plate and the face plate into a pair of waveguide channels separated by the center bar, and a probe assembly, centrally positioned on the rear plate and along the center bar for distributing RF energy to the waveguide channels, comprising the steps of:

(1) stamping the rear plate and the face plate from a sheet metal stock, and machining the center bar from rectangular bar stock having a greater thickness than the sheet metal stock associated with the rear plate and the face plate;

(2) machining a center bar opening, a first cylindrical hole, a second cylindrical hole, and fastener holes within the center bar, the center bar opening extending longitudinally along the center bar and centrally positioned at a midpoint of the center bar, the first and second cylindrical holes positioned at the center of the center bar, the first cylindrical hole extending from one edge of the center bar to the center bar opening and the second cylindrical hole, aligned with the first cylindrical hole, extending from the center bar opening through at least a remaining portion of the center bar, the first and second cylindrical holes forming a guidance hole in the center bar, the fastener holes placed at spaced intervals along both edges of the center bar;

(3) punching fastener holes and holes to accommodate the probe assembly into the rear plate, the fastener holes centrally placed along a major dimension axis of the rear plate and along the periphery of the rear plate, and the probe assembly holes placed at the center of the rear plate;

(4) folding edges of the rear plate to form a tray having a selected depth, and folding an edge along a minor dimension of the rear plate to produce a folded minor dimension edge of the rear plate;

(5) punching fastener holes and slots into the face plate, the fastener holes centrally placed along a major dimension axis of the face plate, and along the periphery of the face plate, and the slots positioned at predetermined intervals along the face plate to achieve a desired radiation pattern;

(6) folding an edge along a minor dimension of the face plate to produce a folded minor dimension edge of the face plate, and folding an edge along each major dimension of the face plate to produce folded major dimension edges of the face plate;

(7) placing the center bar between the rear plate and the face plate;

(8) sliding an edge of the face plate opposite the folded minor dimension edge of the face plate into the folded minor dimension edge of the rear plate, and sliding an edge of the rear plate opposite the folded minor dimension edge of the rear plate into the folded minor dimension edge of the face plate;

(9) installing fasteners within the fastener holes of the rear plate and the face plate and along the center bar;

(10) crimping the folded minor dimension edge of the rear plate and the folded minor and major dimension edges of the face plate;

(11) installing the probe assembly through a probe hole centrally located on the rear plate and into the guidance hole of the center bar; and

(12) attaching the probe assembly to an exterior surface of the rear plate by using fasteners.

36. The manufacturing method of claim 35 further comprising the step of tuning the probe assembly by adjusting the position of a dielectric tuning element of the probe assembly to achieve a desired impedance match between the antenna and a transmission line connected to the antenna.

37. The manufacturing method of claim 35 further comprising the step of applying strips of weather resistant film to the face plate to cover the slots, thereby protecting the interior of the antenna from exposure to the environment.

* * * * *